US005437969A

United States Patent [19]

Schmuck et al.

[11] Patent Number: 5,437,969

[45] Date of Patent: Aug. 1, 1995

[54] COLOR PHOTOGRAPHIC RECODING MATERIAL

[75] Inventors: Arno Schmuck, Leichlingen; Edgar Draber, Odenthal; Michael Missfeldt, Bergisch Gladbach, all of

[73] Assignee: Agfa-Gevaert AG, Leverkusen, Germany

[21] Appl. No.: 178,004

[22] Filed: Jan. 6, 1994

[30] Foreign Application Priority Data

Jan. 18, 1993 [DE] Germany ..... 43 01 106.3

[51] Int. Cl.[6] ..... G03C 1/08

[52] U.S. Cl. ..... 430/508; 430/504; 430/506; 430/509; 430/507; 430/359; 430/570; 430/581; 430/582; 430/583; 430/593; 430/595

[58] Field of Search ..... 430/508, 570, 507, 359, 430/504, 506, 509, 581, 582, 583, 593, 595

[56] References Cited

U.S. PATENT DOCUMENTS 4,806,460 2/1989 Ogawa et al. ..... 430/504
5,084,374 1/1992 Waki et al. ..... 430/504
5,290,669 3/1994 Hirabayashi et al. ..... 430/507

FOREIGN PATENT DOCUMENTS 0304297 2/1989 European Pat. Off. .
0409019 1/1990 European Pat. Off. .
0368271 5/1990 European Pat. Off. .

*Primary Examiner*—Charles L. Bowers, Jr.
*Assistant Examiner*—Geraldine Letscher
*Attorney, Agent, or Firm*—Connolly & Hutz

[57] ABSTRACT

A color photographic silver halide material having at least one silver halide emulsion layer which is cyan coupling and contains a red sensitizer, at least one magenta coupling silver halide emulsion layer containing a green sensitizer and at least one yellow coupling silver halide emulsion layer containing a blue sensitizer on a support, in which the at least one blue sensitive halide emulsion layer contains a further spectral sensitizer (gap sensitizer) whose sensitization maximum lies between the sensitization maxima of the red and green sensitive silver halide emulsion layer and/or the at least one red sensitive silver halide emulsion layer contains an additional spectral sensitizer (gap sensitizer) whose sensitization maximum lies between the sensitization maxima of the green sensitive and the blue sensitive silver halide emulsion layer is distinguished by an increased range of gradations in the region of the maximum densities and a markedly improved detail reproduction in the region of high densities.

18 Claims, No Drawings

COLOR PHOTOGRAPHIC RECODING MATERIAL

This invention relates to a colour photographic recording material having an extended range of gradations in the region of maximum densities and hence markedly improved definition at high densities combined with outstanding colour separation.

Insufficient detail reproduction in the red tones is a weakness of most colour negative papers available on the market. This weakness is particularly apparent when films with very high interimage effects and very great colour saturation are used and subsequently copied on conventional colour negative paper.

A certain improvement in this defect is achieved according to EP 304 297, U.S. Pat. Nos. 4,806,460 and 5,084,374 by using a colour photographic material comprising a first and a second silver halide emulsion layer which are sensitized to a first and a second region of the visible spectrum and both contain colour producing couplers, the second emulsion layer being also sensitized to a certain extent to the first region of the visible spectrum. If, for example, the red sensitive layer in addition contains a green sensitizer, fifteen visible steps are developed in the magenta region instead of the eleven steps which were hitherto developed. Colour photographic materials are normally sensitized for blue light, green light and red light. This applies in particular to printing materials. For reasons of print compatibility (colour papers of various origins must reproduce correct colours with negatives of films of various origins), print materials are sensitized at about 480 nm in the blue sensitive region, at about 550 nm in the green sensitive region and at about 700 nm in the red sensitive region.

In the given example, the red sensitive layer is thus to a slight extent also made sensitive to the wavelength region of around 550 nm with additional green sensitivity or also to the wavelength region of 480 nm with additional blue sensitivity.

As described, this measure produces, for example, in the magenta regions a side density of a different colour, e.g. cyan, but only in regions of high density. In high red density regions, the eye does not perceive this faulty colour density as a falsification of colour but as an increase in the depth of the main colour. This measure can, however, only be used for red tones without colour falsification becoming apparent. The number of additional gradation steps obtained is, however, still insufficient. Moreover, it is a disadvantage that pure magenta and yellow tones are falsified, the extent depending on the nature of the additional sensitization.

It is an object of the present invention to provide a colour photographic material which has an extended range of gradations for the colour separations in the region of maximum densities and hence markedly improved definition at high densities and which is in addition distinguished by great purity of colour, in particular in magenta or yellow.

This problem is solved according to the invention in that in a colour photographic material having at least one cyan coupling silver halide emulsion layer containing a red sensitizer, at least one magenta coupling silver halide emulsion layer containing a green sensitizer and at least one yellow coupling silver halide emulsion layer containing a blue sensitizer, the at least one blue sensitive silver halide emulsion layer contains an additional spectral sensitizer (gap sensitizer) whose sensitization maximum lies between the sensitization maxima of the red sensitive and the green sensitive silver halide emulsion layer and/or the at least one red sensitive silver halide emulsion layer contains an additional spectral sensitizer (gap sensitizer) whose sensitization maximum lies between the sensitization maxima of the green sensitive and the blue sensitive silver halide emulsion layer. The distance between the sensitization maxima of the green or blue sensitizers to the "gap sensitizer" is preferably more than 15 nm and the distance between the sensitization maximum of the red sensitizer to the "gap sensitizer" is preferably more than 30 nm.

The sensitization maximum is determined on the finished material. For this purpose, the material which contains the gap sensitizer is compared with a material which does not contain the gap sensitizer but is otherwise identical. The additional absorption maximum occurring is the sensitization maximum of the gap sensitizer.

The additional sensitizer may be used in any quantity but is preferably used in a quantity of from 0.01 to 3 $\mu mol/m^2$.

Thus, for example, a blue sensitive layer (max at 480 nm) may be additionally sensitized for the region from 580 to 650 nm and a red sensitive layer ($\lambda_{max}$ at 700 nm) may be additionally sensitized for the region from 495 to 530 nm. The red sensitive layer is preferably additionally sensitized for the region from 495 to 530 nm, in particular from 495 to 515 nm.

The material according to the invention is most preferably a material whose support carries, in the given sequence, at least one blue sensitive silver halide emulsion layer containing at least one yellow coupler, an interlayer, at least one green sensitive silver halide emulsion layer containing at least one magenta coupler, an interlayer, at least one red sensitizer silver halide emulsion layer containing at least one cyan coupler and at least one protective layer, characterized in that the red sensitive silver halide emulsion layer is additionally sensitized in accordance with the invention for the region from 495 to 515 nm.

The addition of the "gap sensitizer" to the silver halide emulsion is carried out preferably after the step of chemical ripening.

The silver halides of the silver halide emulsion layers which contain colour couplers may be AgBr, AgBrCl, AgBrClI and AgCl.

The silver halides of all the light sensitive layers preferably contain at least 80 mol % of chloride, in particular from 95 to 100 mol % of chloride, from 0 to 5 mol % of bromide and from 0 to 1 mol % of iodide. The silver halide emulsions may be direct positive emulsions, or preferably, negative emulsions.

The silver halide may consist predominantly of compact crystals, e.g. in the form of regular cubes or octahedrons or transitional forms, but the silver halide may also contain twinned, e.g. platelet shaped crystals whose average ratio of diameter to thickness is preferably at least 5:1, the diameter of a grain being defined as the diameter of a circle whose surface area is equal to the projected surface area of the grain. The layers may also contain tabular silver halide crystals in which the ratio of diameter to thickness is greater than 5:1, e.g. from 12:1 to 30:1.

The silver halide grains may also have a multilayer grain structure, in the simplest case with an inner and an outer grain region (core/shell), in which the different grain regions differ from one another in the halide composition and/or by other modifications, e.g. doping. The average grain size of the emulsions is preferably from 0.2 μm to 2.0 μm and the grain size distribution may be either homodisperse or heterodisperse. The emulsions may contain organic silver salts in addition to silver halide, e.g. silver benzotriazolate or silver behenate.

Two or more types of silver halide emulsions which have been prepared separately may be used as a mixture.

The photographic emulsions may be prepared by various methods from soluble silver salts and soluble halides (e.g. P. Glafkides, Chimie et Physique Photographique, Paul Montel, Paris (1967), G. F. Duffin, Photographic Emulsion Chemistry, The Focal Press, London (1966), F. L. Zelikman et al., Making and Coating Photographic Emulsions, The Focal Press, London (1966).)

Precipitation of the silver halide is preferably carried out in the presence of the binder, e.g. gelatine, at an acid, neutral or alkaline pH, preferably with the addition of silver halide complex formers such as, for example, ammonia, thioethers, imidazole, ammonium thiocyanate or excess halide. The water soluble silver salts and the halides are selectively brought together either successively by the single-jet process or simultaneously by the double-jet process or by any combination of these two processes. Dosing is preferably carried out at increasing inflow rates but without exceeding the "critical" inflow rate at which new nuclei just fail to be formed. The pAg-range may vary within wide limits during precipitation; the so-called pAg controlled process is preferably employed, in which the pAg is kept constant at a particular value or passes through a predetermined profile during precipitation. So-called inverse precipitation using an excess of silver ions may be carried out instead of the preferred method of precipitating with an excess of halides. The silver halide crystals may be grown not only by precipitation but also by physical ripening (Ostwald ripening) in the presence of excess halide and/or silver halide complex formers. Growth of the emulsion grains may even be carried out predominantly by Ostwald ripening in which a fine grain, so-called Lippmann emulsion is preferably mixed with a sparingly soluble emulsion and dissolved and reprecipitated on the latter. precipitation of the silver halide grains may be carried out in the presence of "growth modifiers"; these are substances which influence the growth to give rise to particular forms and surfaces of grains (e.g. 111 surfaces in the case of AgCl).

Salts or complexes of elements of groups 8, 1b, 2b, 3a, 4a and 5a of the periodic system of elements may be used for doping the silver halides during precipitation and/or physical ripening of the silver halide grains.

Precipitation may also be carried out in the presence of sensitizing dyes. Complex formers and/or dyes may be rendered ineffective at any stage, e.g. by altering the pH or by an oxidative treatment.

The binder used is preferably gelatine but this may be partly or completely replaced by other synthetic, semi-synthetic or naturally occurring polymers. Examples of synthetic gelatine substitutes are: polyvinyl alcohol, poly-N-vinyl pyrrolidone, polyacrylamides and polyacrylic acid and derivatives thereof, in particular their copolymers. Examples of naturally occurring gelatine substitutes include other proteins, such as albumin or casein, cellulose, chitine, chitosane, sugar, starch and alginates. Semi-synthetic gelatine substitutes are generally modified natural products. Cellulars derivatives such as hydroxyalkyl cellulose, carboxymethyl cellulose and phthalyl cellulose and gelatine derivatives obtained by a reaction with alkylating or acylating agents or by the grafting of polymerisable monomers are examples of these.

The binders should have a sufficient quantity of functional groups available to enable sufficiently resistant layers to be produced by a reaction with suitable hardeners. Such functional groups are in particular amino groups but also carboxyl groups, hydroxyl groups and active methylene groups. Gelatine, which is the binder preferably used, may be obtained by acid or alkaline decomposition. The preparation of such gelatines has been described, for example, in the Science and Technology of Gelatine, published by A. G. Ward and A. Courts, Academic Press 1977, page 295 et seq. The gelatine used should contain as little as possible of photographically active impurities (inert gelatine). Gelatines having a high viscosity and low tendency to swelling are particularly advantageous. The gelatine may be partly or completely oxidized.

When crystal formation has been completed or at an earlier stage, the soluble salts are removed from the emulsion, e.g. by shredding and washing, by flocculation and washing, by ultrafiltration or by means of ion exchangers.

The photographic emulsions may contain compounds for preventing fogging or for stabilizing the photographic function during production, storage or photographic processing.

Azaindenes are particularly suitable, especially tetra and pentaazaindenes, in particular those which are substituted with hydroxyl or amino groups. Such compounds have been described, e.g. by Birr in Z. Wiss, Phot. 47 (1952), pages 2–58. Salts of metals, aromatic sulphonic or suphinic acids such as benzene sulfinic acid and heterocyclic compounds which contain nitrogen, such as nitrobenzimidazole, nitroindazole, (substituted) benzotriazoles or benzothiazolium salts may also be used as anti-foggants. Heterocyclic compounds which contain mercapto groups are particularly suitable, e.g. mercaptobenzothiazoles, mercaptobenzimidazoles, mercaptotetrazoles, mercaptothiadiazoles or mercaptopyrimidines, and these mercaptoazoles may also contain a water solubilizing group, e.g. a carboxyl group or a sulphur group. Other suitable compounds have been published in Research Disclosure No. 17643 (1978), Section VI.

The stabilizers may be added to the silver halide emulsions before, during or after ripening. The compounds may, of course, also be added to other photographic layers which are associated with a silver halide layer.

Mixtures of two or more of the above mentioned compounds may also be used.

The silver halide emulsions are normally chemically ripened, for example by the action of gold compounds or compounds of divalent sulphur.

The photographic emulsion layers or other hydrophilic colloid layers of the light sensitive material prepared according to the invention may contain surface active agents for various purposes, such as coating auxiliaries to prevent electric charging or to improve the slip properties and agents for emulsifying the dispersion, for preventing adherence and for improving the photographic characteristics (e.g. development acceleration, high contrast, sensitization, etc.).

Cyanine dyes are suitable sensitizing dyes, in particular those of the following classes:

1. Red Sensisitizers

Dicarbocyanines containing naphthothiazole or benzothiazole as basic end groups, which may be substituted in the 5 and/or 6 position by halogen, methyl or methoxy, and 9,11-alkylene-bridged dicarbocyanines, in particular 9,11-neopentylene-thiadicarbocyanines carrying alkyl or sulphoalkyl substituents on the nitrogen.

Green Sensitizers 9-ethyloxacarbocyanines which are substituted in the 5 position by chlorine or phenyl and carry alkyl or sulphoalkyl groups, preferably sulphoalkyl substituents, on the nitrogen of the benzoxazole groups.

3. Blue Sensitizers

Methine cyanines carrying benzoxazole, benzothiazole, benzoselenazole, naphthoxazole or naphthothiazole as basic end groups, which may be substituted in the 5- and/or 6 position by halogen, methyl, methoxy and have at least one, preferably two, sulphoalkyl substituents on the nitrogen. Further, apomerocyanines containing a rhodamine group.

Sensitizers for the region from 495 to 530 nm may be representatives of the following classes of substances corresponding to Formulae I to XI, XXVI and XXVII:

(I)

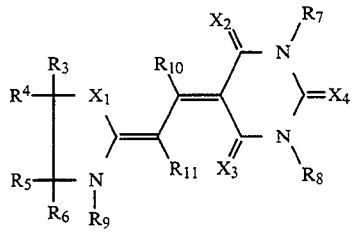

(II)

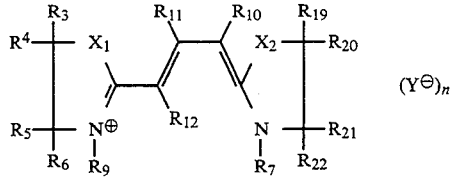

(III)

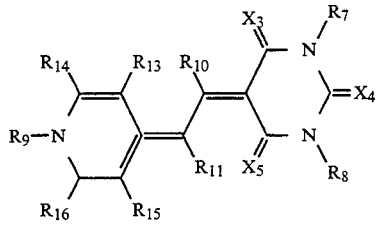

(IV)

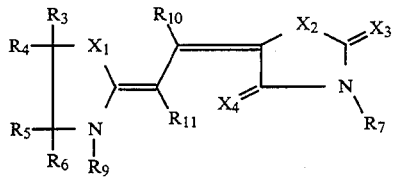

(V)

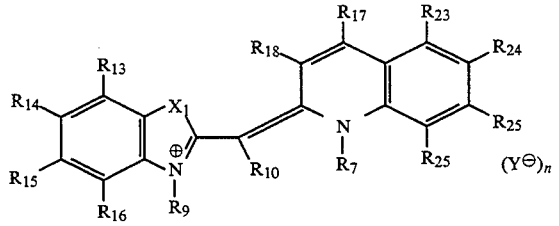

(VI)

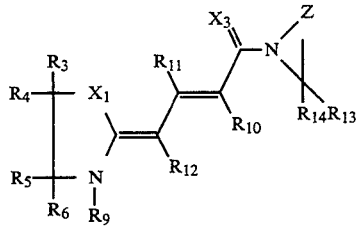

-continued (VII)

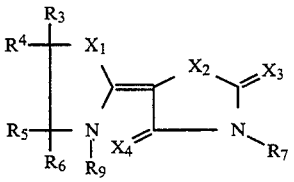

(VIII)

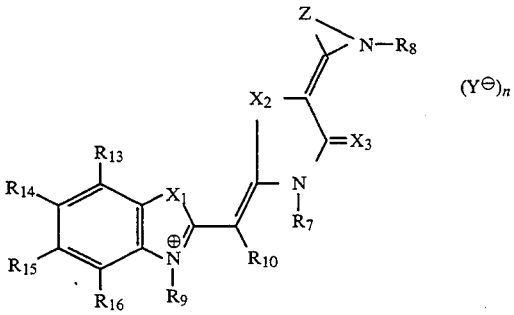

(IX)

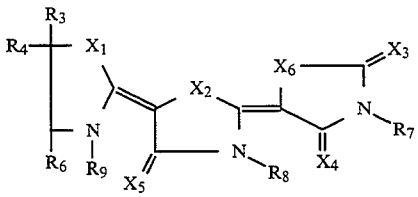

(XI)

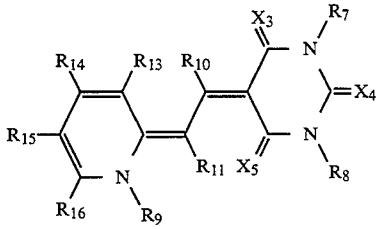

(XXVI)

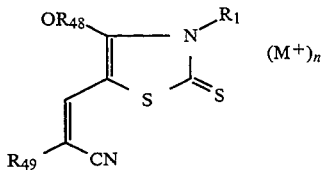

(XXVII)

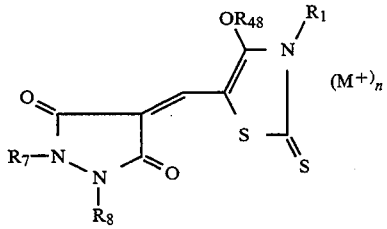

wherein $X_1$–$X_6$ denote O, $NR_1$, S, Se, Te, $P(R_1)$, $P(R_1)_3$, $CH_2$, $CHR_2$, $C(R_2)_2$ $R_1$ denotes alkyl, optionally substituted sulphoalkyl, carboxyalkyl or aryl, in particular phenyl, denotes aryl, in particular phenyl, alkyl, in particular with 1 to 5 carbon atoms, or CN $R_3$, $R_4$, $R_5$, $R_6$, $R_{19}$, $R_{20}$, $R_{21}$ and $R_{22}$ denote hydrogen, halogen, alkoxy, aryloxy, cyano, hydroxy, sulfo, carboxy, alkoxycarbonyl, aryloxycarbonyl, acylaminosulfonyl, aminosulfonyl, alkylaminosulfonyl, dialkylaminosulfonyl, arylaminosulfonyl, diarylaminosulfonyl, aryl, arylmercapto, alkylmercapto or alkyl or $R_3$ and $R_6$ together or $R_{19}$ and $R_{22}$ together form a $\pi$ bond $R_4$ and $R_5$ together or $R_{20}$ and $R_{21}$ together form a 3 to 12 membered ring which may contain heteroatoms and multiple bonds, $R_7$, $R_8$ and $R_9$ denote alkyl, optionally substituted sulfoalkyl, carboxyalkyl or aryl, $R_{10}$, $R_{11}$ and $R_{12}$ denote hydrogen, halogen, cyano, aryl, aryloxy, arylmercapto, alkyl, alkoxy or alkylmercapto, $R_{13}$, $R_{14}$, $R_{15}$, $R_{16}$, $R_{17}$, $R_{18}$, $R_{23}$, $R_{24}$, $R_{25}$ and $R_{26}$ denote hydrogen, halogen, alkoxy, cyano, hydroxy, sulfo, carboxy, alkoxycarbonyl, aryloxycarbonyl, acyloxycarbonyl, acylaminosulfonyl, aminosulfonyl, alkylaminosulfonyl, arylaminosulfonyl, diarylaminosulfonyl, aryl, aryloxy, arylmercapto, alkyl or alkylmercapto, $R_{48}$ denotes hydrogen, alkyl, sulfoalkyl, carboxyalkyl, acyl or a negative charge, $R_{49}$ —CN, —CON$(R_1)_2$ or —$SO_2R_1$, Z denotes the remaining members of a 3 to 12 membered ring which may contain heteroatoms and double bonds, $M^{\oplus}$ denotes a cation, $Y^{\ominus}$ denotes an anion and n stands for 0or 1.

Aryl and alkyl groups may be further substituted. The acyl may in particular be an alkylcarbonyl or arylcarbonyl.

Suitable substituents of the sulfoalkyl residues are e.g. OH and halogen, particularly Cl.

The following are suitable examples of Formulae I to XI and their sensitization maxima in nm:

LS-I-1: $X_1$, $X_2$, $X_3$=O, $X_4$=S, $R_3$ and $R_6$ together denote a $\pi$ bond, and $R_4$ and $R_5$ together denote —CH=CH—CH=CH—, $R_7$ and $R_8$ denote $C_2H_5$, $R_9$ and $R_{10}$ denote $CH_3$ and $R_{11}$ denotes H; 498;

LS-I-2: $X_1$, $X_2$, $X_3$=O, $X_4$=S, $R_3$ and $R_6$ together denote a $\pi$ bond, $R_4$ and $R_5$ together denote the remaining members of a 5-phenylbenzoxazole, $R_7$ denotes $CH_3$, $R_8$ denotes $C_2H_5$, $R_9$ denotes $(CH_2)_3$—$SO_3H$, $R_{10}$ and $R_{11}$ denote H; 498;

LS-I-3: $X_1$, $X_2$, $X_3$=O, $X_4$=S, $R_3$ and $R_6$ together denote a $\pi$ bond, $R_4$ and $R_5$ together denote the remaining members of a 5-hydroxybenzoxazole, $R_8$ denotes $CH_3$, $R_7$ and $R_9$ denote $C_2H_5$, $R_{10}$ $R_{11}$ denote H, 495 nm;

LS-I-4: $X_1$, $X_2$, $X_3$=O, $X_4$ =S, $R_3$ and $R_6$ together denote a $\pi$ bond, $R_4$ and $R_5$ together denote the remaining members of a 5-chlorobenzoxazole, $R_7$ and $R_8$ denote $CH_3$, $R_9$ denotes $C_2H_5$, $R_{10}$ and $R_{11}$ denote H; 495;

LS-I-5: $X_1$, $X_2$, $X_3$=O, $X_4$=S, $R_3$ and $R_6$ together denote a $\pi$ bond, $R_4$ and $R_5$ denote 2-furyl, $R_7$ denotes H, $R_8$ and $R_9$ denote $CH_3$, $R_{10}$ and $R_{11}$ denote H; 500;

LS-I-6: $X_1$, $X_2$, $X_3$=O, $X_4$=S, $R_3$ and $R_6$ together denote a $\pi$ bond, $R_4$ and $R_5$ denote 2-furyl, $R_8$ denotes H, $R_7$ denotes $CH_3$, $R_9$ denotes $(CH_2)_3$ —$SO_3H$, $R_{10}$ and $R_{11}$ denote H; 505;

LS-I-7: $X_1$, $X_2$, $X_3$=O, $X_4$=S, $R_3$ and $R_6$ together denote a $\pi$ bond, $R_4$ and $R_5$ denote 2-furyl, $R_7$ and $R_9$ denote $CH_3$, $R_8$ denotes $C_2H_5$, $R_{10}$ and $R_{11}$ denote H; 500;

LS-I-8: $X_1$, $X_2$, $X_3$=O, $X_4$=S, $R_3$ and $R_6$ together denote a $\pi$ bond, $R_4$ and $R_5$ denote 2-furyl, $R_7$ and $R_8$ denote $CH_3$, $R_9$ denotes $(CH_2)_3$—$SO_3H$, $R_{10}$ and $R_{11}$ denote H; 492;

LS-I-9: $X_1$, $X_2$, $X_3$=O, $X_4$=S, $R_3$ and $R_6$ together denote a $\pi$ bond, $R_4$ and $R_5$ denote phenyl, $R_7$ denotes $CH_3$, $R_8$ denotes $C_2H_5$, $R_9$ denotes 2-chloro-3-sulfopropyl, $R_{10}$ and $R_{11}$ denote H; 493;

LS-I-10: $X_1$, $X_2$, $X_3$=O, $X_4$=S, $R_3$ and $R_6$ together denote a $\pi$ bond, $R_4$ and $R_5$ denote phenyl, $R_7$ denotes $CH_3$, $R_8$ denotes $C_2H_5$, $R_9$ denotes $(CH_2)_3$ —$SO_3H$, $R_{10}$ and $R_{11}$ denote H; 495;

LS-I-11: $X_1$, $X_2$, $X_3$=O, $X_4$=S, $R_3$ and $R_6$ together denote a $\pi$ bond, $R_4$ and $R_5$ denote phenyl, $R_7$ and $R_8$ denote $CH_3$, $R_9$ denotes $C_2H_5$, $R_{10}$ and $R_{11}$ denote H; 499;

LS-I-12 $X_1$, $X_2$, $X_3$=O, $X_4$=S, $R_3$ and $R_6$ together denote a $\pi$ bond, $R_4$ and $R_5$ denote phenyl, $R_7$ and $R_8$ denote $CH_3$, $R_9$ denotes $CH_2$—COOH, $R_{10}$ and $R_{11}$ denote H; 497;

LS-I-13: $X_1$, $X_2$, $X_3$=O, $X_4$=S, $R_3$ and $R_6$ together denote a $\pi$ bond, $R_4$ and $R_5$ together denote the remaining members of a 5-chlorobenzoxazole, $R_7$ and $R_8$ denote $CH_3$, $R_9$ denotes $(CH_2)_3SO_3H$, $R_{10}$ and $R_{11}$ denote H; 495;

LS-II-14: $X_1$, $X_2$ =S, $R_3$ and $R_6$ together denote a $\pi$ bond, $R_4$ and $R_5$ together denote —CH=CH—CH=CH—, $R_7$ and $R_9$ denote $C_2H_5$, $R_{10}$, $R_{11}$, $R_{19}$, $R_{20}$, $R_{21}$ and $R_{22}$ denote H, $R_{12}$ denote CN, $Y^{\ominus}$ denotes $ClO_4^{\ominus}$, n=1; 500;

LS-II-15: $X_1$, $X_2$=S, $R_3$, $R_4$ , $R_5$, $R_6$, $R_{10}$, $R_{11}$ and $R_{12}$ denote H, $R_{19}$ and $R_{22}$ together denote $\pi$ bond, $R_{20}$ denotes N-morpholinocarbonyl, $R_7$, $R_9$ and $R_{21}$ denote $CH_3$, $Y^{\ominus}$ denotes $I^{\ominus}$, n=1; 532;

LS-II-16: $X_1$=O, $X_2$=S, $R_3$ and $R_6$ together denote a $\pi$ bond, $R_4$ and $R_5$ together denote —CH=C$(CH_3)$—C$(CH_3)$=CH—, $R_7$ denotes $CH_3$, $R_9$ denotes $(CH_2)_3SO_3^{\ominus}$, $R_{10}$, $R_{11}$, $R_{12}$ , $R_{19}$, $R_{20}$, $R_{21}$ and $R_{22}$ denote H, n=O; 497;

LS-II-17: $X_1$ and $X_2$=S, $R_2$ and $R_6$ together denote a $\pi$ bond, $R_4$ denotes 2-hydroxyisopropyl, $R_5$, $R_7$ and $R_9$ denote $CH_3$, $R_{10}$, $R_{11}$, $R_{12}$, $R_{19}$, $R_{20}$, $R_{21}$, and $R_{22}$ denote H, $Y^{\ominus}$ denotes $I^{\ominus}$, n=1; 505;

LS-II-18: $X_1$, $X_2$=S, $R_{19}$ and $R_{22}$ together denote a $\pi$ bond, $R_{20}$ denotes $OC_2H_5$, $R_5$, $R_{10}$, $R_{11}$, $R_{12}R_3$, $R_4$, $R_6$ and $R_{21}$ denote H; $R_7$ and $R_9$ denote $CH_3$, $Y^{\ominus}$ denotes $I^{\ominus}$, n=1;

LS-II-19: $X_1$, $X_2$=S, $R_3$ and $R_6$ together denote a $\pi$ bond, $R_4$ denotes phenyl, $R_5$, $R_7$ and $R_9$ denote $CH_3$, $R_{10}$, $R_{11}$, $R_{12}$, $R_{19}$, $R_{20}$, $R_{21}$ and $R_{22}$ denote H, $Y^{\ominus}$ denotes $I^{\ominus}$, n=1; 532;

LS-II-20: $X_1$=O, $X_2$=S, $R_3$ and $R_6$ together denote a $\pi$ bond ,$R_4$ and $R_5$ together denote the remaining members of a 5-methylbenzoxazole, $R_7$ denotes $CH_3$, $R_9$ denotes $CH_2$—CH(Cl)—$CH_2$—$SO_3^{\ominus}$, $R_{10}$, $R_{11}$, $R_{12}$, $R_{19}$, $R_{20}$, $R_{21}$ and $R_{22}$ denote H, n=O; 492;

LS-II-21: $X_1$, $X_2$=S, $R_{19}$ and $R_{22}$ together denote a $\pi$ bond, $R_3$, $R_4$, $R_5$, $R_6$, $R_{10}$, $R_{11}$, $R_{12}$, $R_{20}$ and $R_{21}$ denote H, $R_7$ and $R_9$ denote $CH_3$, $Y^{\ominus}$ denotes $I^{\ominus}$, n=1; 517;

LS-II-22: $X_1$=O, $X_2$=S, $R_3$ and $R_6$ together denote a $\pi$ bond, $R_4$ and $R_5$ together denote the remaining members of a 5-phenylbenzoxazole, $R_7$ and $R_9$ denote $CH_3$, $R_{10}$, $R_{11}$, $R_{12}$, $R_{19}$, $R_{20}$, $R_{21}$ and $R_{22}$ denote H; $Y^{\ominus}$ denotes $CH_3OSO_3^{\ominus}$,n=1; 492;

LS-II-23: $X_1$, $X_2$=S, $R_{19}$ and $R_{22}$ together denote a $\pi$ bond, $R_3$, $R_4$, $R_5$, $R_6$, $R_{10}$, $R_{11}$, $R_{12}$=H; $R_7$, $R_9$, $R_{11}$ and $R_{20}$, $R_{21}$=$CH_3$, $Y^{\ominus}$ denote $I^{\ominus}$, n=1; 518;

LS-II-24: $X_1$, $X_2$=S, $R_3$ and $R_6$ together denote a $\pi$ bond, $R_4$ and $R_5$ together denote —CH=CH—CH=CH—, $R_7$ denotes $C_2H_5$, $R_9$ denotes $CH_3$, $R_{10}$, $R_{11}$, $R_{19}$, $R_{20}$, $R_{21}$ and $R_{22}$ denote H, $R_{12}$ denotes CN, $Y^{\ominus}$ denotes $ClO_4^{\ominus}$, n=1; 500;

LS-II-25: $X_1$, $X_2$=S, $R_{19}$ and $R_{22}$ together denote a $\pi$ bond, $R_3$, $R_4$, $R_5$, $R_6$, $R_{10}$, $R_{11}$, $R_{12}$ and $R_{20}$ denote H, $R_{21}$ denotes phenyl, $R_7$ and $R_9$ denote $C_2H_5$, $Y^{\ominus}$ denotes $ClO_4^{\ominus}$, n=1; 520;

LS-II-26: $X_1$, $X_2$=O, $R_3$ and $R_6$ together and $R_{19}$ and $R_2$ together denote in each case a $\pi$ bond, $R_4$, $R_{10}$, $R_{12}$, and $R_{20}$ denote H, $R_5$ and $R_{21}$ denote phenyl, $R_{11}$ denotes $CH_3$, $R_7$ denotes $(CH_2)_3SO_3\ominus$, $R_9$ denotes $(CH_2)_3SO_3H$, n=0; 515;

LS-II-27: $X_1$, $X_2$=O, $R_3$ and $R_6$ together and $R_{19}$ and $R_{22}$ together denote in each case a $\pi$ bond, $R_4$, $R_{10}$, $R_{12}$ and $R_{20}$ denote H, $R_5$ and $R_{21}$ denote $CH_3$, $R_{11}$ denotes $C_2H_5$, denotes $(CH_2)_3SO_3\ominus$, $R_9$ denotes $(CH_2)_3SO_3H$, n=0; 500;

LS-II-28: $X_1$, $X_2$=O, $R_3$ and $R_6$ together and $R_{19}$ and $R_{22}$ together in each case denote a $\pi$ bond, $R_4$, $R_{10}$, $R_{12}$ and $R_{20}$ denote H, $R_5$ and $R_{21}$ denote $CH_3$, $R_7$ and $R_{11}$ denote $C_2H_5$, $R_9$ denotes $(CH_2)_3SO_3\ominus$, n=0; 498;

LS-II-29: $X_1$, $X_2$=O, $R_3$ and $R_6$ together and $R_{19}$ and $R_{22}$ together in each case denote a $\pi$ bond, $R_4$, $R_{10}$, $R_{12}$ and $R_{20}$ denote H, $R_5$ and $R_{21}$ denote phenyl, $R_7$ and $R_{11}$ denote $C_2H_5$, $R_9$ denotes $(CH_2)_3SO_3\ominus$, n=O; 513;

LS-II-30: $X_1$, $X_2$=O, $R_3$ and $R_6$ together and $R_{19}$ and $R_{22}$ together in each case denote a $\pi$ bond, $R_4$, $R_{10}$, $R_{12}$ and $R_{20}$ denote H, $R_5$ and $R_{21}$ denote phenyl, $R_7$ and $R_{11}$ denote $C_2H_5$, $R_9$ denotes $(CH_2)_3SO_3\ominus$, n=O; 513;

LS-II-31: $X_1$, $X_2$=O, $R_3$ and $R_6$ together and $R_{19}$ and $R_{22}$ together in each case denote a $\pi$ bond, $R_4$, $R_{10}$, $R_{12}$ and $R_{20}$ denote H, $R_5$ and $R_{21}$ denote phenyl, $R_9$ denotes $(CH_2)_3SO_3\ominus$, $R_7$ denotes $(CH_2)_3SO_3H$, $R_{11}$ denotes $C_2H_5$, n=0; 515;

LS-II-32: $X_1$, $X_2$=O, $R_3$ and $R_6$ together and $R_{19}$ and $R_{22}$ together denote in each case a $\pi$ bond, $R_4$, $R_5$, $R_{20}$, $R_{21}$ and $R_{11}$ denote $CH_3$, $R_{10}$ and $R_{12}$ denote H, $R_9$ denotes $(CH_2)_3SO_3\ominus$, $R_7$ denotes $(CH_2)_3SO_3H$, n=O; 510;

LS -II-33: $X_1$, $X_2$=O, $R_3$ and $R_6$ together and $R_{19}$ and $R_{22}$ together denote in each case a $\pi$ bond, $R_4$, $R_5$, $R_{20}$ and $R_{21}$ denote $CH_3$, $R_9$ denotes $(CH_2)_3SO_3\ominus$, $R_7$ denotes $(CH_2)_3SO_3H$, $R_{10}$ and $R_{12}$ denote H, $R_{11}$ denotes $C_2H_5$, n=O; 510;

LS-II-34: $X_1$, $X_2$=O, $R_3$ and $R_6$ together and $R_{19}$ and $R_{22}$ together denote in each case a $\pi$ bond, $R_4$ and $R_{20}$ denote ethoxycarbonyl, $R_5$, $R_{21}$, $R_7$, $R_9$ and $R_{11}$ denote $CH_3$, $R_{10}$ and $R_{12}$ denote H, $Y\ominus$ denotes $ClO_4\ominus$, n=1; 498;

LS-II-35: $X_1$, $X_2$=O, $R_3$ and $R_6$ together and $R_{19}$ and $R_{22}$ together denote in each case a $\pi$ bond, $R_4$ and $R_{20}$ denote ethoxycarbonyl, $R_5$, $R_7$, $R_9$ and $R_{21}$ denote $CH_3$, $R_{10}$, $R_{11}$ and $R_{12}$ denote H, $Y\ominus$ denotes $ClO_4\ominus$, n=1; 502;

LS-II-36: $X_1$, $X_2$=O, $R_3$ and $R_6$ together and $R_{19}$ and $R_{22}$ together in each case denote a $\pi$ bond, $R_4$ and $R_{20}$ denote ethoxycarbonyl, $R_5$ and $R_{denote\ CH3}$, $R_7$ denotes $(CH_2)_3SO_3\ominus$, $R_9$ denotes $(CH_2)_3SO_3H$, $R_{10}$ and $R_{12}$ denote H, $R_{11}$ denotes $C_2H_5$, n=); 500;

LS-II-37 $X_1$, $X_2$=O, $R_3$, and $R_6$ together and $R_{19}$ and $R_{22}$ together denote in each case a $\pi$ bond, $R_4$ and $R_{20}$ denote ethoxycarbonyl, $R_5$, $R_{11}$, and $R_{21}$ denote $CH_3$, $R_7$ denotes $(CH_2)_3SO_3\ominus$, $R_9$ denotes $(CH_2)_3SO_3H$, $R_{10}$ and $R_{12}$ denote H, n=0; 500;

LS-II-38 $X_1$, $X_2$=O, $R_3$ and $R_5$ together and $R_{19}$ and $R_{22}$ together denote in each case a $\pi$ bond, $R_4$ and $R_{20}$ denote ethoxycarbonyl, $R_5$, $R_{11}$ and $R_{21}$ denote $CH_3$, $R_9$ denotes $(CH_2)_3SO_3\ominus$, $R_7$ denotes $C_2H_5$, $R_{10}$ and $R_{12}$ denote H, n=0; 499;

LS-II-39 $X_1$, $X_2$=O, $R_3$ and $R_5$ together and $R_{19}$ and $R_{22}$ together denote in each case a $\pi$ bond, $R_4$ and $R_{20}$ denote ethoxycarbonyl, $R_5$, and $R_{21}$ denote $CH_3$, $R_9$ denotes $(CH_2)_3SO_3\ominus$, $R_7$ and $R_{11}$ denote $C_2H_5$, $R_{10}$ and $R_{12}$ denote H, n=0; 499;

LS-II-40 $X_1$, $X_2$=O, $R_3$ and $R_6$ together and $R_{19}$ and $R_{22}$ together denote in each case a $\pi$ bond, $R_4$, $R_5$, $R_{11}$, $R_{20}$ and $R_{21}$ denote $CH_3$, $R_9$ denotes $(CH_2)_3SO_3\ominus$, $R_7$ denotes $C_2H_5$, $R_{10}$ and $R_{12}$ denote H; n=0; 508;

LS-II-41 $X_1$, $X_2$=O, $R_3$ and $R_6$ together and $R_{19}$ and $R_{22}$ together denote in each case a $\pi$ bond, $R_4$, $R_5$, $R_{20}$ and $R_{21}$ denote $CH_3$, $R_9$ denotes $(CH_2)_3SO_3\ominus$, $R_7$ and $R_{11}$ denote $C_2H_5$, $R_{10}$ $R_{12}$ denote H, N=0; 508;

LS-II-42 $X_1$=S, $X_2$=O, $R_{19}$ and $R_{22}$ together denote a $\pi$ bond, $R_{20}$ and $R_{21}$ denote the remaining members of a 5-phenyl benzoxazole, $R_9$ denotes $(CH_2)_3SO_3\ominus$, $R_7$ and $R_{11}$ denote $C_2H_5$, $R_{10}$, $R_{12}R_3$, $R_4$, $R_5$ and $R_6$ denote H, n=0, 502;

LS-II-43 $X_1$=S, $X_2$=O, $R_{19}$ and $R_{22}$ together denote a $\pi$ bond, $R_{20}$ and $R_{21}$ denote the remaining members of a 5-chlorobenzoxazole, $R_9$, denotes $(CH_2)_3SO_3\ominus$, $R_7$ and $R_{11}$ denote $C_2H_5$, $R_{10}$, $R_{12}$, $R_3$, $R_4$, $R_5$ and $R_6$ denote H, n=0; 498;

LS-II-44 $X_1$, $X_2$=S, $R_{19}$ and $R_{22}$ together denote a $\pi$ bond, $R_3$, $R_4$, $R_5$, $R_6$, $R_{10}$, $R_{12}$ and $R_{20}$ denote H, $R_{21}$ denotes phenyl, $R_9$, denotes $(CH_2)_3SO_3\ominus$, $R_7$ denotes $(CH_2)_3SO_3H$, $R_{11}$ denotes $C_2H_5$, n=0; 505;

LS-II-45 $X_1$, $X_2$=S, $R_{19}$ and $R_{22}$ together denote a $\pi$ bond, $R_3$, $R_4$, $R_5$, $R_6$, $R_{10}$, $R_{12}$ and $R_{20}$ denote H, $R_{21}$ denotes Cl, $R_9$ denotes $(CH_2)_3SO_3\ominus$, $R_7$ denotes $(CH_2)_3SO_3H$, $R_{11}$ denotes $C_2H_5$, n=0; 502;

LS-II-46 $X_1$, $X_2$=S, $R_{19}$ and $R_{22}$ together denote a $\pi$ bond, $R_{20}$ and $R_{21}$ denote $CH_3$, $R_9$, denotes $(CH_2)_3SO_3\ominus$, $R_7$ denotes $(CH_2)_3SO_3H$, $R_3$, $R_4$, $R_5$, $R_6$, $R_{10}$ and $R_{12}$ denote H, $R_{11}$ denotes $C_2H_5$, n=0; 520;

LS-II-47 $X_1$, $X_2$=S, $R_{19}$ and $R_{21}$ together denote a $\pi$ bond, $R_{20}$ and $R_{21}$ denote $CH_3$, $R_9$ denotes $(CH_2)_3SO_3\ominus$, $R_7$ and $R_{11}$ denote $C_2H_5$, $R_3$, $R_4$, $R_5$, $R_6$, $R_{10}$ and $R_{12}$ denote H, n=0; 520;

LS-III-48 $X_3$, $X_5$=O, $X_4$=S, $R_7$, $R_8$ and $R_9$ denote $CH_3$, $R_{10}$, $R_{11}$, $R_{13}$, $R_{14}$, $R_{15}$ and $R_{16}$ denote H; 497;

LS-III-49 $X_3$, $X_5$=O, $X_4$=S, $R_7$ denotes $(CH_2)_3SO_3H$, $R_8$ and $R_9$ denote $CH_3$, $R_{10}$, $R_{11}$, $R_{13}$, $R_{14}$, $R_{15}$ $R_{16}$ denote H; 500;

LS-III-50 $X_3$, $X_5$=O, $X_4$=S, $R_7$ and $R_8$ denote $(CH_2)_3SO_3H$, $R_9$, denotes $CH_3$, $R_{10}$, $R_{11}$, $R_{13}$, $R_{14}$, $R_{15}$ and $R_{16}$ denote H; 505;

LS-III-51 $X_3$, $X_5$=O, $X_4$=S, $R_7$ and $R_8$ denote $CH_3$, $R_9$, denotes $(CH_2)_3SO_3H$, $R_{10}$, $R_{11}$, $R_{13}$, $R_{14}$, $R_{15}$ and $R_{16}$ denote H; 500;

LS-IV-52 $X_1$, $X_3$=S, $X_2$, $X_4$=O, $R_3$, $R_4$, $R_5$, $R_6$, $R_{10}$ and $R_{11}$ denote H; $R_7$ and $R_8$ denote $C_2H_5$; 500;

LS-IV-53 $X_1$, $X_3$=S, $X_2$, $X_4$=O, $R_3$, $R_4$, $R_5$, $R_6$, $R_{10}$ and $R_{11}$ denote H, $R_7$ denotes $C_2H_5$, $R_9$ denotes $CH_3$; 500;

LS-IV-54 $X_1$, $X_3$=S, $X_2X_4$=O, $R_3$, $R_4$, $R_5$, $R_6$, $R_{10}$ and $R_{11}$ denote H, $R_7$ denotes $C_2H_5$, $R_9$ denotes $(CH_2)_3SO_3H$; 500;

LS-IV-55 $X_1$, $X_3$=S, $X_2$, $X_4$=O, $R_3$, $R_4$, $R_5$, $R_6$, $R_{10}$ $R_{11}$ denote H, $R_7$ denotes $(CH_2)_3SO_3H$, $R_9$ denotes $C_2H_5$; 500;

LS-IV-56 $X_1$=$CH_2$, $X_2$, $X_3$=S, $X_4$=O, $R_3$, $R_4$, $R_5$, $R_6$ and $R_{11}$ denote H, $R_7$ denote $C_2H_5$, $R_9$ denotes $(CH_2)_2CH(CH_3)SO_3H$, $R_{10}$ denotes $CH_3$; 523;

LS-IV-57 $X_1$=$CH_2$, $X_2$, $X_3$=S, $X_4$=O, $R_3$, $R_4$, $R_5$, $R_6$ and $R_{11}$ denote H, $R_7$ and $R_{10}$ denote $C_2H_5$, $R_9$, denotes $(CH_2)_2$—$CH(CH_3)SO_3H$; 522;

LS-IV-58 $X_1$=$CH_2$, $X_2$=$NCH_3$, $X_3$=S, $X_4$=O, $R_3$, $R_4$, $R_5$, $R_6$, $R_{10}$ $R_{11}$ denote denote H, $R_7$ denotes $CH_3$, $R_9$ denotes $(CH_2)_3SO_3H$; 500;

LS-IV-59 $X_1$=$CH_2$, $X_2$=$NCH_3$, $X_3$=S, $X_4$=O, $R_3$, $R_4$, $R_5$, $R_6$, $R_{10}$, and $R_{11}$ denote H, $R_7$ and $R_9$ denote $CH_3$, 495;

LS-V-60 $X_1$=O, $R_7$ denotes $C_2H_5$, $R_9$ denotes $(CH_2)_4SO_3\ominus$, $R_{10}$, $R_{13}$, $R_{14}$, $R_{16}$, $R_{17}$, $R_{18}$, $R_{23}$, $R_{25}$ and $R_{26}$ denote H, $R_{15}$ denotes phenyl, $R_{24}$ denotes $OCH_3$, n=0; 500;

LS-V-61 $X_1$=O, $R_7$ and $R_9$ denote $C_2H_5$, $R_{10}$, $R_{13}$, $R_{14}$, $R_{16}$, $R_{17}$, $R_{18}$, $R_{23}$, $R_{25}$ and $R_{26}$ denote H, $R_{15}$ denotes phenyl, $R_{24}$ denotes $OCH_3$, $Y\ominus$ denotes $I\ominus$, n=1; 500;

LS-V-62 $X_1$=O, $R_7$ denotes $C_2H_5$, $R_9$, denotes $(CH_2)_3SO_3\ominus$, $R_{10}$, $R_{13}$, $R_{14}$, $R_{16}$, $R_{17}$, $R_{18}$, $R_{23}$, $R_{25}$ and $R_{26}$ denote H, $R_{15}$ denotes phenyl, $R_{24}$ denotes $OCH_3$, n=0; 500;

LS-V-63 $X_1$=O, $R_7$ denotes $C_2H_5$, $R_9$ denotes $(CH_2)_2SO_3\ominus$, $R_{10}$, $R_{13}$, $R_{14}$, $R_{16}$, $R_{17}$, $R_{18}$, $R_{23}$, $R_{25}$ and $R_{26}$ denote H, $R_{15}$ denotes phenyl, $R_{24}$ denotes $OCH_3$, n=0: 500;

LS-V-64 $X_1$=O, $R_7$ denotes $(CH_2)_3SO_3H$, $R_9$ denotes $(CH_2)_3SO_3\ominus$ $R_{10}$, $R_{13}$, $R_{14}$, $R_{16}$, $R_{17}$, $R_{18}$, $R_{23}$, $R_{25}$ and $R_{26}$ denote H, $R_{15}$ denotes phenyl, $R_{24}$ denotes $OCH_3$, n=0; 505;

LS-V-65 $X_1$=O, $R_7$ denotes $(CH_2)_3SO_3H$, $R_9$ denotes $(CH_2)_2SO_3\ominus$ $R_{10}$, $R_{13}$, $R_{14}$, $R_{16}$, $R_{17}$, $R_{18}$, $R_{23}$, $R_{25}$ and $R_{26}$ denote H, $R_{15}$ denotes phenyl, $R_{24}$ denotes $OCH_3$, n=0; 505;

LS-V-66 $X_1$=O, $R_7$ denotes $C_2H_5$, $R_9$ denotes $(CH_2)_3SO_3\ominus$, $R_{10}$, $R_{13}$, $R_{14}$, $R_{16}$, $R_{17}$, $R_{18}$, $R_{23}$, $R_{25}$ and $R_{26}$ denote H, $R_{15}$ denotes chlorine, $R_{24}$ denotes $OCH_3$, n=0; 500;

LS-V-67 $X_1$=O, $R_7$ denotes $(CH_2)_3SO_3H$, $R_9$ denotes $(CH_2)_3SO_3\ominus$, $R_{10}$, $R_{13}$, $R_{14}$, $R_{16}$, $R_{17}$, $R_{18}$, $R_{23}$, $R_{25}$ and $R_{26}$ denote H, $R_{15}$ denotes chlorine, $R_{24}$ denotes $OCH_3$, n=0; 503;

LS-V-68 $X_1$=S, $R_7$ and $R_9$ denote $C_2H_5$, $R_{10}$, $R_{13}$, $R_{14}$, $R_{16}$, $R_{23}$, $R_{24}$, $R_{25}$ and $R_{26}$ denote H, $R_{15}$ denotes $SO_3\ominus$, n=0; 500;

LS-VI-69 $X_1$=O, $X_3$=S, Z denotes —$CH_2$—$CH_2$—$CH_2$—, $R_3$ and $R_6$ together denote a $\pi$ bond, $R_4$ and $R_5$ together denote —CH=CH—CH=CH—, $R_9$ denotes $(CH_2)_3SO_3H$, $R_{10}$ denotes CN, $R_{11}$, $R_{12}$, $R_{13}$ and $R_{14}$ denote H; 500;

LS-VI-70 $X_1$=O, $X_3$=S, Z denotes —$CH_2$,—$CH_2$—$CH_2$—, $R_3$ and $R_6$ together denote a $\pi$ bond, $R_4$ and $R_5$ together denote the remaining members of a 5-phenylbenzoxazole, $R_9$ denotes $(CH_2)_3SO_3H$, $R_{10}$ denotes CN, $R_{11}$, $R_{12}$, $R_{13}$ and $R_{14}$ denote H; 510;

LS-VI-71 $X_1$=O, $X_3$=S, Z denotes —$CH_2$—$CH_2$—$CH_2$—, $R_3$ and $R_6$ together denote a $\pi$ bond, $R_4$ and $R_5$ together denote the remaining members of a 5-chlorobenzoxazole, $R_9$ denotes $(CH_2)_3SO_3H$, $R_{10}$ denotes CN, $R_{11}$, $R_{12}$, $R_{13}$ and $R_{14}$ denote H; 505;

LS-VI-72 $X_1$=O, $X_3$=S, Z denotes $CH_2$—$CH_2$—$CH_2$—, $R_3$ and $R_6$ together denote a $\pi$ bond, $R_4$ and $R_5$ together denote the remaining members of a 5-phenylbenzoxazole, $R_9$ denotes $(CH_2)_2SO_3H$, $R_{10}$ denotes CN, $R_{11}$, $R_{12}$, $R_{13}$ and $R_{14}$ denote H; 510;

LS-VII-73 $X_1$, $X_2$, $X_3$=S, $X_4$=O, $R_3$ and $R_6$ together denote a $\pi$ bond, $R_4$ denote $C_2H_5OCOCH$=CH—, $R_5$ and $R_9$ denote $CH_3$, $R_7$ denotes HOOC—$CH_2$; 495;

LS-VII-74 $X_1$, $X_2$, $X_3$=S, $X_4$=O, $R_3$ and $R_6$ together denote a $\pi$ bond, $R_4$ denotes H, $R_5$ denotes $CH_3$, $R_7$ denotes HOOC—$CH_2$, $R_9$ denotes $(CH_2)_3SO_3H$; 495;

LS-VII-75 $X_1$, $X_2$, $X_3$=S, $X_4$=O, $R_3$ and $R_6$ together denote a $\pi$ bond, $R_4$ denotes H, $R_5$ and $R_9$ denote $CH_3$, $R_7$ denotes $(CH_2)_3SO_3H$; 495;

LS-VII-76 $X_1$, $X_2$, $X_3$=S, $X_4$=O, $R_3$ and $R_6$ together denote a $\pi$ bond, $R_4$ denotes H, $R_5$ denotes $CH_3$, $R_7$ denotes $C_2H_5$, $R_9$ denotes $(CH_2)_3SO_3H$; 495;

LS-VII-77 $X_1$, $X_2$=S, $X_3$=O, Z denotes —$CH_2$—$CH_2$—$CH_2$, $R_7$ and $R_9$ denote $C_2H_5$, $R_8$ denote $C_4H_9$, $R_{10}$, $R_{15}$ $R_{16}$ denote H, $R_{13}$ and $R_{14}$ together denote —CH=CH—CH=CH—, $Y\ominus$ denotes $NO_3\ominus$, n=1; 498;

LS-VIII-78 $X_1$, $X_2$=S, $X_3$=O, Z denotes —$CH_2$—$CH_2$—$CH_2$, $R_7$ denotes $(CH_2)_3SO_3\ominus$, $R_8$ and $R_9$ denote $C_2H_5$, $R_{10}$, $R_{15}$ and $R_{16}$ denote H, $R_{13}$ and $R_{14}$ together denote —CH=CH—CH=CH—, n=0; 500;

LS-VIII-79 $X_1$, $X_2$ , =S, $X_3$=O, Z denotes —$CH_2$—$CH_2$—$CH_2$, $R_7$ denotes $(CH_2)_3SO_3\ominus$, $R_8$ denotes $C_2H_5$, $R_9$ denotes $(CH_2)_3SO_3H$, $R_{10}$, $R_{15}$ and $R_{16}$ denote H, $R_{13}$ and $R_{14}$ together denote —CH=CH—CH=CH—, n=0; 503;

LS-IX-80 $X_1$=$NCH_3$, $X_2$, $X_3$=S, $X_4$, $X_5$, $X_6$=O, $R_3$ and $R_6$ together denote a $\pi$ bond, $R_4$ and $R_5$ together denote —CH=CH—CH=CH—, $R_7$ and $R_9$ denote $CH_3$, $R_8$ denotes $C_2H_5$; 505;

LS-IX-81 $X_1$=$NCH_3$, $X_2$, $X_6$=S, $X_3$=$C(CN)_2$, $X_4$, $X_5$=O, $R_3$ $R_6$ together denote a $\pi$ bond, $R_4$ and $R_5$ together denote —CH=CH—CH=CH—, $R_7$ and $R_8$ denote $C_2H_5$, $R_9$ denotes $(CH_2)_3SO_3H$; 520;

LS-IX-82 $X_1$=$NCH_3$, $X_2$, $X_6$=S, $X_3$=$C(CN)_2$, $X_4$, $X_5$=O, $R_3$ and $R_6$ together denote a $\pi$ bond, $R_4$ and $R_5$ together denote —CH=CH—CH=CH—, $R_7$ and $R_8$ denote $C_2H_5$, $R_9$ denotes $CH_3$; 520;

LS-IX-83 $X_1$=$NCH_3$, $X_2$, $X_3$=S, $X_4$, $X_5$, $X_6$=O, $R_3$ and $R_6$ together denote a $\pi$ bond, $R_4$ and $R_5$ together denote —CH=CH—CH=CH—, $R_7$ denotes $CH_3$, $R_8$ denotes $C_2H_5$, $R_9$ denotes $(CH_3,)_3SO_3H$; 508;

LS-IX-84 $X_1$, $X_2$ , $X_4$, $X_5$=O, $X_3$, $X_6$=S, $R_3$ , and $R_6$ together denote a $\pi$ bond, $R_4$ and $R_5$ denote 2-furyl, $R_7$ $R_8$ denote $C_2H_5$, $R_9$ denote $CH_3$; 500;

LS-IX-85 $X_1$, $X_2$ , $X_3$, $X_5$=O, $X_3$, $X_6$=S, $R_3$ and $R_6$ together denote a $\pi$ bond, $R_4$ and $R_5$ denote phenyl, $R_7$ and $R_8$ denote $C_2H_5$, $R_9$ denotes $(CH_2)_3SO_3H$; 498;

LS-IX-86 $X_1$, $X_2$ , $X_3$, $X_5$=O, $X_3$, $X_6$=S, $R_3$ and $R_6$ together denote a $\pi$ bond, $R_4$ and $R_5$ denote $CH_3$, $R_7$ and $R_8$ denote $C_2H_5$, $R_9$ denotes $(CH_2)_3SO_3H$; 495;

LS-IX-87 $X_1$, $X_2$, $X_4$, $X_5$=O, $X_3$, $X_5$=S, $R_3$ and $R_6$ together denote a $\pi$ bond, $R_4$ and $R_5$ denote 2-furyl, $R_7$ and $R_8$ denote $C_2H_5$, $R_9$ denotes $(CH_2)_3SO_3H$; 502;

LS-X-88 $X_3$, $X_5$=O, $X_4$=S, $R_7$, $R_8$ and $R_9$ denote $C_2H_5$, $R_{10}$, $R_{11}$, $R_{13}$, $R_{14}R_{15}$ and $R_{16}$ denotes H; 498;

LS-X-89 $X_3$, $X_5$=O, $X_4$=S, $R_7$, $R_{10}$, $R_{11}$, $R_{13}$, $R_{14}$, $R_{15}$ and $R_{16}$ denote H, $R_8$ and $R_9$ denote $CH_3$; 490;

LS-X-90 $X_1$, $X_5$=O, $X_4$=S, $R_7$, $R_8$ and $R_9$ denote $CH_3$, $R_{10}$, $R_{11}$, $R_{13}$, $R_{14}$, $R_{15}$ and $R_{16}$ denote H; 500;

LS-X-91 $X_3$, $X_5$=O, $X_4$=S, $R_7$ and $R_8$ denote $CH_3$, $R_9$ denotes $(CH_2)_3SO_3H$, $R_{10}$, $R_{11}$, $R_{13}$, $R_{14}$, $R_{15}$ and $R_{16}$ denote H; 503;

LS-XI-92 $X_1$, $X_4$=S, $X_3$, $X_5$=O, $R_7$ and $R_8$ denote $C_2H_5$, $R_9$ and $R_{10}$ denote $CH_3$, $R_{11}$ denotes H, $R_{13}$ denotes $CH_3S$; 500;

LS-XI-93: $X_1$, $X_4$=S, $X_3$, $X_5$=O, $R_7$, $R_a$ and $R_9$ denote $CH_3$, $R_{10}$ and $R_{11}$ denote H, $R_{13}$ denotes $CH_3S$; 505;

LS-XI-94: $X_1$, $X_4$=S, $X_3$, $X_5$=O, $R_7$ and $R_{13}$ denote $CH_3$, $R_8$ denotes $C_2H_5$, $R_9$ denotes $(CH_2)_3SO_3H$, $R_{10}$ and $R_{11}$ denote H; 495;

LS-XI-95: $X_1$, $X_4$=S, $X_3$, $X_5$=O, $R_7$ and $R_8$ denote $CH_3$, $R_9$ denotes $(CH_2)_3SO_3H$, $R_{10}$ and $R_{11}$ denote H, $R_{13}$ denotes phenyl; 502;

LS-I-134: $X_1$, $X_2$, $X_3$=O, $X_4$=S, $R_3$ and $R_6$ together denote a $\pi$ bond, $R_4$ and $R_5$ together denote the remaining members of a 5-carboxymethylenoxy-benzoxazole(pyridiniumsalt), $R_7$ denotes $CH_3$, $R_8$, $R_9$ denote $C_2H_5$, $R_{10}$, $R_{11}$ denote H; 495 nm;

LS-II-135: $X_1=O$, $X_2=S$, $R_3$ and $R_6$ together denote a $\pi$ bond, $R_4$ and $R_5$ together denote the remaining members of a 5-carboxymethylenoxybenzoxazole, $R_7$ $CH_3$, $R_9$ $C_2H_5$, $R_{10}$, $R_{11}$, $R_{12}$, $R_{19}$, $R_{20}$, $R_{21}$, $R_{22}$ H, $Y^{\ominus}$ $I^{\ominus}$, n=1; 500;

LS-II-136: $X_1$, $X_2=O$, $R_3$ and $R_6$ together and $R_{19}$ and $R_{22}$ together denote the $\pi$ bond, $R_4$ and $R_5$ together and $R_{20}$ and $R_{21}$ together denote the remaining bonds of a 5-benzoyloxybenzoxazols, $R_7$, $R_9$ $C_2H_5$, $R_{10}$, $R_{11}$, $R_{12}$ H, $Y^{\ominus}$ $C_2H5OSO_3^{\ominus}$, n=1; 513;

LS-XXVI-137: $R_1$ $C_2H_5$, $R_{48}$ a denotes a negative charge, $R_{49}$ denotes CN, $M^+$ $K^+$, n=1; 495;

LS-XXVI-138: $R_1$ $C_2H_5$, $R_{48}$ denotes a negative charge, $R_{49}$ denotes —$CONH_2$, $M^+$ $Na^+$, n=1; 500;

LS-XXVI-139: $R_1$ $C_2H_5$, $R_{48}$ H, $R_{49}$ —$CONH_2$, n=O; 500;

LS-XXVI-140: $R_1$ $C_2H_5$, $R_{48}$ a denotes a negative charge, $R_{49}$ denotes —$ONHC_2H_5$, $M^+$ $HN^+$ $(C_2H_5)_3$, n=1; 500;

LS-XXVI-141: $R_1$ $C_2H_5$, $R_{48}$ a denotes a negative charge,

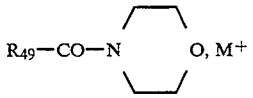

denotes $Na^+$, n=1; 500;

LS-XXVI-142: $R_1$ $C_2H_5$, $R_{48}$ denotes a negative charge, $R_{49}$ denotes $CONHCH_2$—CH=$CH_2$, $M^+$ $Na^+$, n=1; 500;

LS-XXVI-143: $R_1$ $C_2H_5$, $R_{48}$ denotes a negative charge, $R_{49}$ denotes $CONHCH_2CH_2OH$, $M^+$ $K^+$, n=1; 500;

LS-XXVI-144 $R_1$ H, $R_{48}$ denotes a negative charge, $R_{49}$ $CONH_2$, $M^+$ $K^+$, n=1; 500;

LS-XXVI-145: $R_1$ H, $R_{48}$ denotes a negative charge, $R_{49}$ CONHphenyl, $M^+$ denotes $K^+$, n=1; 510;

LS-XXVI-146: $R_1$ ethyl, $R_{48}$ denotes a negative charge, $R_{49}$ $SO_2$-phenyl, $M^+$ $K^+$, n=1; 495;

LS-XXVII-147: $R_1$ $CH_2COOC_2H_5$, $R_7$, $R_8$ phenyl, $R_{48}$ denotes a negative charge, $M^+$ $HN^+$ $(C_2H_5)_3$, n=1; 500;

LS-XXVII-148: $R_1$ $CH_2COOC_2H_5$, $R_7$, $R_8$ phenyl, $R_{48}$ denotes a negative charge, $M^+$ $HN^{\oplus}$ $(C_2H_5)_3$, n=1: 500;

LS-XXVII-149: $R_1$ $C_2H_5$, $R_7$, $R_8$ phenyl, $R_{48}$ denotes a negative charge, $M^+$ $HN^+$ $(C_2H_5)_3$, n=1; 500;

LS-XXVII-150: $R_1$, $R_7$, $R_8$ phenyl, $R_{48}$ denotes a negative charge, $M^+$ $HN^{\oplus}$ $(C_2H_5)_3$, n=1; 500.

Compounds corresponding to Formulae I, II, III, IV, V, X and XI are preferred and within Formula I those of the Formula XII are preferred:

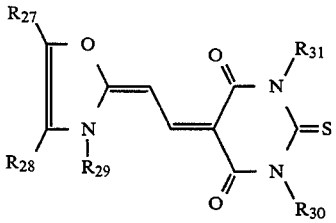

(XII)

within Formula II those of the Formulae XIII and XIV are preferred:

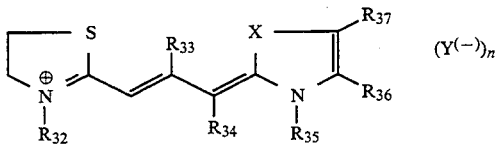

(XIII)

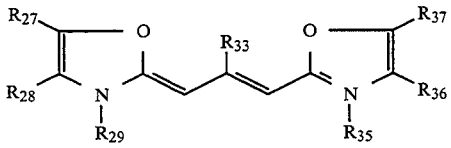

(XIV)

within Formula III, those of Formula XV are preferred:

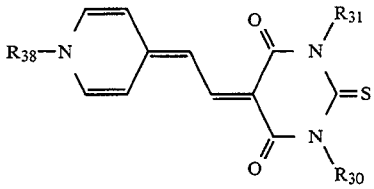

(XV)

within Formula IV, those of Formula XVI are preferred:

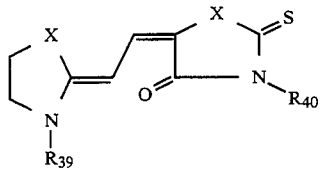

(XVI)

within Formula V, those of Formula XVII are preferred:

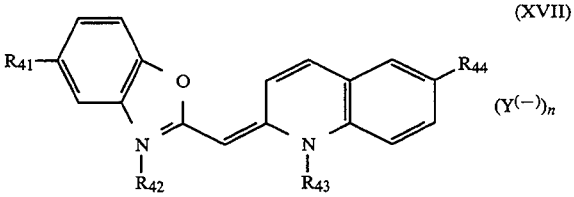

(XVII)

within Formula X, those of Formula XVIII are preferred:

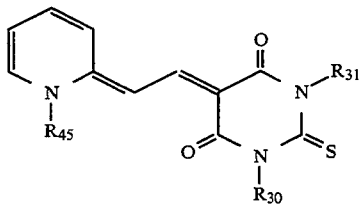

(XVIII)

within Formula XI, those of Formula XIX are preferred:

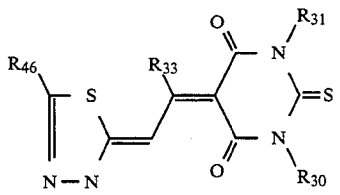

(XIX)

The substituents have the following meanings:

X: O, S, Se, $NR_1$;

$R_{27}$, $R_{28}$: H, $CH_3$, phenyl, 2-furyl, Cl, methoxycarbonyl, ethoxycarbonyl;

$R_{29}$, $R_{32}$, $R_{35}$, $R_{38}$, $R_{39}$, $R_{40}$, $R_{42}$, $R_{43}$, $R_{45}$, $R_{47}$: methyl, ethyl, optionally substituted sulfoalkyl, carboxyalkyl, $R_{30}$, $R_{31}$: hydrogen or $R_{29}$;

$R_{33}$: hydrogen, methyl, ethyl;

$R_{34}$: H, CN;

$R_{36}$, $R_{37}$: H, $CH_3$, $C_2H_5$, phenyl, ethoxy, morpholinocarbonyl, 1-hydroxyisopropyl, Cl, methoxycarbonyl, exthoxycarbonyl;

$R_{41}$: H, Cl, $CH_3$, OH, $OCH_3$, phenyl;

$R_{44}$: H, $OCH_3$, $R_{46}$: H, $CH_3$, $SCH_3$, Cl, phenyl.

Sensitizers for the absorption range of from 580 to 650 nm may be members of the following classes of dyes corresponding to Formulae XX to XXII:

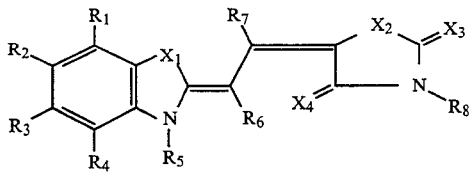

(XX)

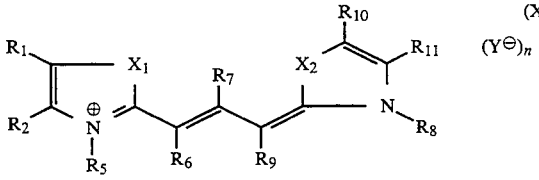

(XXI)

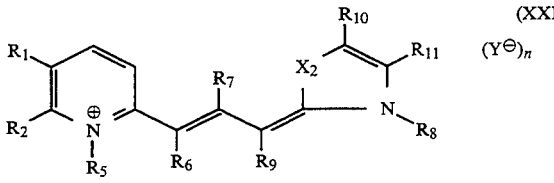

(XXII)

wherein $R_1$, $R_2$, $R_3$, $R_4$, $R_{10}$ and $R_{11}$ denote hydrogen, halogen, alkoxy, aryloxy, cyano, hydroxy, sulfo, carboxy, alkoxycarbonyl, aryloxycarbonyl, acylaminosulfonyl, aminosulfonyl, alkyl aminosulfonyl, dialkyl aminosulfonyl, aryl aminosulfonyl, diaryl aminosulfonyl, aryl, aryl mercapto, alkyl mercapto or alkyl or $R_1$ and $R_2$ together or $R_2$ and $R_3$ together or $R_3$ and $R_4$ together or $R_{10}$ and $R_{11}$ together stand for an aromatic or heteroaromatic 3 to 12 membered ring, in particular a condensed benzo or naphtho ring, and $R_5$ and $R_8$ denote aryl, alkyl, optionally substituted sulfoalkyl or carboxyalkyl, $R_6$, $R_7$ and $R_9$ denote hydrogen, halogen, cyano, aryl, arylmercapto, aryloxy, alkyl, alkylmercapto or alkoxy, $X_1$, $X_2$, $X_3$ and $X_4$ denote O, NR, S, Se, Te, PR, $PR_3$, $CH_2$, CH-Alkyl, $C(Alkyl)_2$, $C(Aryl)_2$, $Y^{\ominus}$ denotes an anion and n stands for O or 1.

Preferred compounds of Formulae XX to XXII correspond to Formulae XXIII, XXIV and XXV:

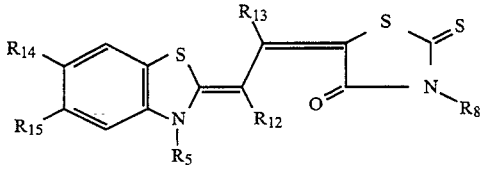

(XXIII)

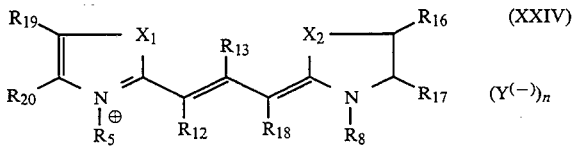

(XXIV)

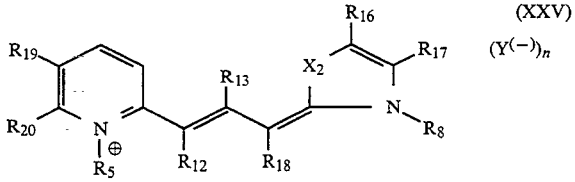

(XXV)

wherein $R_{12}$, $R_{13}$ and $R_{18}$ denote H or $CH_3$, $R_{14}$ $R_{15}$ denote H, $CH_3$, Cl or phenyl $R_{16}$, $R_{17}$, $R_{19}$ and $R_{20}$ denote H, $CH_3$, Cl or phenyl or $R_{16}$ together with $R_{17}$ or $R_{19}$ together with $R_{20}$ stand for the remaining members of an optionally substituted aromatic or heteraromatic ring and $R_5$, $R_8$, $X_1$ and $X_2$ have the meanings indicated above.

The following are suitable examples of Formulae XX to XXII and their sensitization maxima in nm:

LS-XX-96 $X_1$, $X_2$, $X_3$=S, $X_4$=O, $R_1$, $R_2$, $R_3$, $R_4$, $R_7$ denote H, $R_5$ and $R_6$ denote $CH_3$, $R_8$ denotes $C_2H_5$; 595;

LS-XX-97 $X_1$, $X_2$, $X_3$=S, $X_4$=O, $R_1$, $R_2$, $R_3$, $R_4$, $R_6$ and $R_7$ denote H, $R_5$ denotes $CH_3$, $R_8$ denotes $C_2H_5$; 590;

LS-XX-98 $X_1$, $X_2$, $X_3$=S, $X_4$=O, $R_1$, $R_2$, $R_3$, $R_4$ and $R_7$ denote H, $R_5$ and $R_8$ denote $C_2H_5$, $R_6$ denotes $CH_3$; 600;

LS-XX-99 $X_1$, $X_2$, $X_3$=S, $X_4$=O, $R_1$, $R_2$, $R_3$, $R_4$, $R_6$ and $R_7$ denote H, $R_5$ denotes $(CH_2)_3SO_3H$, $R_8$ denotes $C_2H_5$; 600;

LS-XX-100 $X_1$, $X_2$, $X_3$=S, $X_4$=O, $R_1$, $R_2$, $R_3$, $R_4$ and $R_7$ denote H, $R_5$, $R_6$ and $R_8$ denote $C_2H_5$; 600;

LS-XXI-101 $X_1$, $X_2$=S, $R_1$, $R_2$, $R_{10}$ and $R_{11}$ denote phenyl, $R_5$, $R_7$ and $R_8$ denote $C_2H_5$, $R_6$ and $R_9$ denote H, $Y^{\ominus}$ denotes $I^{\ominus}$, n=1; 582;

LS-XXI-102 $X_1$, $X_2$=S, $R_1$ together with $R_2$ and $R_{10}$ together with $R_{11}$ in each case denote —CH=C($CH_3$)—C($CH_3$)=CH—, $R_5$ and $R_8$ denote $(CH_2)_2$—COOH, $R_6$, $R_7$ and $R_9$ denote H, $Y^{\ominus}$ denotes $I^{\ominus}$, n=1; 600;

LS-XXI-103 $X_1$, $X_2$-S, $R_1$ together with $R_2$ and $R_{10}$ together with $R_{11}$ in each case denote —CH=C($CH_3$)—C($CH_3$)=CH—, $R_5$ denotes $CH_2COO(CH_3$-

$)_4—SO_3^{\ominus}$, $R_8$ denotes $CH_2COO(CH_2)_4SO_3H$, $R_6$, $R_7$ and $R_9$ denote H, n=O; 600;

LS-XXI-104 $X_1$, $X_2$=S, $R_1$ together with $R_2$ denote

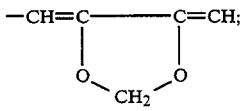

$R_{10}$ together with $R_{11}$ denote the remaining members of a 6-methylthiazole, $R_5$, and $R_7$ denote $C_2H_5$, $R_6$ and $R_9$ denote H, $R_8$ denotes $(CH_2)_3SO_3^{\ominus}$, n=0; 597;

LS-XXI-105 $X_1$, $X_2$=S, $R_1$ together with $R_2$ and $R_{10}$ together with $R_{11}$ in each case denote

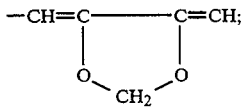

$R_5$ and $R_7$ denote $C_2H_5$, $R_6$ and $R_9$ denote H, $R_8$ denotes $(CH_2)_3SO_3^{\ominus}$, n=0; 620;

LS-XXI-106 $X_1$, $X_2$=S, $R_1$ together with $R_2$ denote

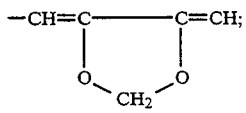

$R_{10}$ together with $R_{11}$ denote —CH=C(CH-$_3$)—C($CH_3$)=CH—, $R_5$ denotes $(CH_2)_4SO_3^{\ominus}$, $R_6$ and $R_9$ denote H, $R_7$ and $R_8$ denote $C_2H_5$, n=0; 600;

LS-XXI-107 $X_1$, $X_2$=S, $R_1$ together with $R_2$ denote the remaining members of a 5-methylthiazole, $R_{10}$ together with $R_{11}$ denote the remaining members of a 5-methoxythiazole, $R_5$ denotes $C_2H_5$, $R_6$and $R_9$ denote H, $R_7$ denotes $CH_2$—$CH_2$-phenyl, $R_8$ denotes $(CH_2)_3SO_3^{\ominus}$, n=0; 593;

LS-XXI-108 $X_1$, $X_2$=S, $R_1$ together with $R_2$ and $R_{10}$ together with $R_{11}$ denote —CH=CH—CH=CH—, $R_5$, and $R_8$ denote $C_2H_5$, $R_6$ and $R_9$ denote H, $R_7$ denotes $CH_3$, $Y^{\ominus}$ denotes $Br^{\ominus}$, n=1; 618;

LS-XXI-109 $X_1$, $X_2$=S, $R_1$ together with $R_2$ and $R_{10}$ together with $R_{11}$ denote —CH=CH—CH=CH, $R_5$ and $R_8$ denote $C_2H_5$, $R_6$, and $R_9$ denote $CH_3$, $R_7$ denotes H, $Y^{\ominus}$ denotes $I^{\ominus}$, n=1; 590;

LS-XXI-110 $X_1$, $X_2$=S, $R_1$ together with $R_2$ denotes

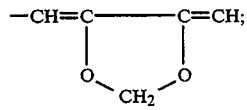

$R_{10}$ together with $R_{11}$ denote the remaining members of 5-hydroxybenzothiazole substituted by

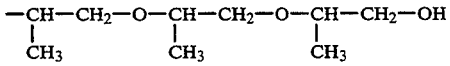

on the OH group, $R_5$ denotes $(CH_2)_3SO_3^{\ominus}$, $R_7$ and $R_8$ denote $CH_3$, $R_6$ and $R_9$ denote H, n=0; 600;

LS-XXI-111 $X_1$, $X_2$=S, $R_1$ together with $R_2$ and $R_{10}$ together with $R_{11}$ denote —CH=CH—CH=CH—, $R_5$ and $R_8$ denote $(CH_2)_2COOH$, $R_6$, $R_7$ and $R_9$ denote H, $Y^{\ominus}$ denotes $I^{\ominus}$, n=1; 600;

LS-XXI-112 $X_1$, $X_2$=S, $R_1$ together with $R_2$ and $R_{10}$ together with $R_{11}$ in each case denote —CH=CH—CH=CH—, $R_5$ denotes $C_2H_5$, $R_6$, and $R_9$ denote H, $R_7$ denotes $CH_3$, $R_8$ denotes $(CH_2)_4SO_3^{\ominus}$, n=0; 620;

LS-XXI-113 $X_1$=S, $X_2$=Se, $R_1$ together with $R_2$ denote —CH=CH—CH=CH—, $R_{10}$ together with $R_{11}$ denote the remaining members of a 5-methoxyselenazole, $R_5$, and $R_7$ denote $CH_3$, $R_6$ and $R_9$ denote H, $R_8$ denotes $C_2H_5$, $Y^{\ominus}$ denotes $ClO_4^{\ominus}$, n=1; 590;

LS-XXI-114 $X_1$, $X_2$=S, $R_1$ together with $R_2$ and $R_{10}$ together with $R_{11}$ in each case denote —CH=CH—CH=CH—, $R_5$, and $R_8$ denote $C_2H_5$, $R_6$, $R_7$ and $R_9$ denote H, $Y^{\ominus}$ denotes $C_2H_5OSO_3^{\ominus}$, n=1; 585;

LS-XXI-115 $X_1$, $X_2$=S, $R_1$ together with $R_2$ and $R_{10}$ together with $R_{11}$ denote —CH=CH—CH=CH—, $R_5$ and $R_8$ denote $(CH_2)_3COOH$, $R_6$, $R_7$ and $R_9$ denote H, $Y^{\ominus}$ denotes $I^{\ominus}$, n=1; 588;

LS-XXI-116 $X_1X_2$=S, $R_1$ together with $R_2$ and $R_{10}$ together with $R_{11}$ in each case denote —CH=CH—CH=CH—, $R_5$, and $R_8$ denote $CH_3$, $R_6$ and $R_9$ denote H, $R_7$ denotes $C_2H_5$, $Y^{\ominus}$ denotes $Cl^{\ominus}$, n=1; 605;

LS-XXI-117 $X_1$, $X_2$=S, $R_1$ together with $R_2$ denote —CH=CH—CH=CH—, $R_{10}$ together with $R_{11}$ denote

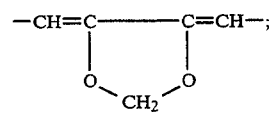

$R_5$ denotes $(CH_2)_2SO_2(CH_2)_2$—$SO_3^{\ominus}$, $R_6$ and $R_9$ denote H, $R_7$ $R_8$ denote $C_2H_5$, n=0; 598;

LS-XXI-118 $X_1$, $X_2$=S, $R_1$ together with $R_2$ and $R_{10}$ together with $R_{11}$, in each case denote —CH=CH—CH=CH—, $R_5$ denotes $(CH_2)_2SO_2(CH_2)$-$_2SO_3^{\ominus}$, $R_6$, $R_7$ and $R_9$ denote H, $R_8$ denotes $(CH_2)_2$—$SO_2(CH_2)_2SO_3H$, n=0; 595;

LS-XXI-119 $X_1$, $X_2$=S, $R_1$ together with $R_2$ and $R_{10}$ together with $R_{11}$ in each case denote the remaining members of a 5-methylbenzothiazole, $R_5$ and $R_8$ denote $C_2H_5$, $R_6$, $R_7$ and $R_9$ denote H, $Y^{\ominus}$ denotes $I^{\ominus}$, n=1; 592;

LS-XXI-120 $X_1$, $X_2$=S, $R_1$ together with $R_2$ and $R_{10}$ together with $R_{11}$ in each case denote —CH=CH—CH=CH—, $R_5$ denotes $C_2H_5$, $R_7$ denotes $CH_3$, $R_6$ and $R_9$ denote H, $R_8$ denotes $CH_2$—CH(OH-)—$CH_2$—$SO_3$, n=O; 580;

LS-XXI-121 $X_1$, $X_2$=S, $R_1$ together with $R_2$ and $R_{10}$ together with $R_{11}$ in each case denote the remaining members of a 5-chlorobenzothiazole, $R_5$ denotes $(CH_2)_3SO_3^{\ominus}$, $R_6$ and $R_9$ denote H, $R_7$ denotes $C_2H_5$, $R_8$ denotes $(CH_2)_3SO_3H$, n=0; 650;

LS-XXI-122 $X_1$, $X_2$=S, $R_1$ together with $R_2$ denote

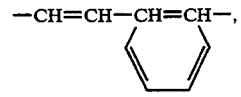

$R_{10}$ together with $R_{11}$ denote the remaining members of a 5-hydroxybenzothiazole substituted by $$-(\underset{\underset{CH_3}{|}}{CH}-CH_2-O)_3H$$

on the OH group, $R_5$ denotes $(CH_2)_3SO_3\ominus$, $R_6$ and $R_9$ denote H, $R_7$ and $R_8$ denote $CH_3$, n=0; 600;

LS-XXI -123 $X_1$, $X_2$=S, $R_1$ together with $R_2$ denote $$-CH=\underset{\underset{CH_3}{|}}{C}-\underset{\underset{CH_3}{|}}{C}=CH-,$$

$R_{10}$ together with $R_{11}$ denote the remaining members of a 5-hydroxybenzothiazole substituted by $$-(\underset{\underset{CH_3}{|}}{CH}-CH_2-O)_2-H$$

on the OH group, $R_5$ denotes $(CH_2)_3SO_3\ominus$, $R_6$ and $R_9$ denote H, $R_8$ denotes $CH_3$, $R_7$ denotes $C_2H_5$, n=0; 640;

LS-XXI-124 $X_1$, $X_2$=S, $R_1$ together with $R_2$ and $R_{10}$ together with $R_{11}$ in each case denote the remaining members of a 6-phenoxybenzothiazole, $R_5$ and $R_8$ denote $CH_3$, $R_6$ and $R_9$ denote H, $R_7$ denotes $C_2H_5$, $Y\ominus$ denotes $ClO_4\ominus$, n=1; 585;

LS-XXI-125 $X_1$=Se, $X_2$=S, $R_1$ together with $R_2$ denote

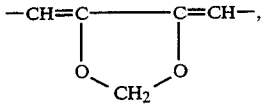

$R_{10}$ together with $R_2$ denote the remaining members of a 5-hydroxybenzothiazole, $R_5$ denotes $(CH_2)_3SO_3\ominus$, $R_6$, and $R_9$ denote H, $R_7$ denotes $C_2H_5$, $R_8$ denotes $CH_3$, n=0; 600;

LS-XXI-126 $X_1$=O, $X_2$=Se, $R_1$ together with $R_2$ denote

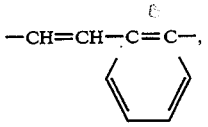

$R_{10}$ together with $R_{11}$ denote the remaining members of a 5-methyl-6-methoxybenzoselenazole, $R_5$ denotes $(CH_2)_3SO_3\ominus$, $R_6$ and $R_9$ denote H, $R_7$ and $R_8$ denote $C_2H_5$, n=0; 620;

LS-XXI-127 $X_1$=O, $X_2$=S, $R_1$ together with $R_2$ denote

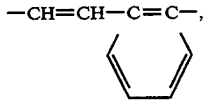

$R_{10}$ together with $R_{11}$ denote the remaining members of a 5-chlorobenzothiazole, $R_5$ denotes $(CH_2)_3SO_3\ominus$, $R_6$ and $R_9$ denote H, $R_7$ denotes $C_2H_5$, $R_8$ denotes $(CH_2)_3SO_3H$, n=0; 610;

LS-XXI-128 $X_1$=O, $X_2$=S, $R_1$ together with $R_2$ denote

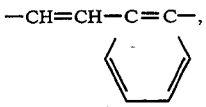

$R_{10}$ together with $R_{11}$ denote the remaining members of a 5-chlorobenzothiazole, $R_5$ denotes $(CH_2,)_3SO_3\ominus$, $R_6$ and $R_9$ denote H, $R_7$ denotes $C_2H_5$, $R_8$ denotes $(CH_2)_4SO_3H$, n=O; 610;

LS-XXI-129 $X_1$, $X_2$=Se, $R_1$ together with $R_2$ and $R_{10}$ together with $R_{11}$ in each case denote —CH=CH—CH=CH—, $R_5$ and $R_8$ denote $C_2H_5$, $R_6$ and $R_9$ denote H, $R_7$ denotes $CH_3$, $Y\ominus$ denotes $ClO_4\ominus$, n=1; 635;

LS-XXI-130 $X_1$=S, $X_2$=N—$C_2H_5$, $R_1$ together with $R_2$ denotes

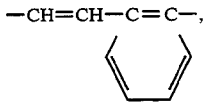

$R_{10}$ together with $R_{11}$ denote $$-CH=\underset{\underset{Cl}{|}}{C}-\underset{\underset{Cl}{|}}{C}=CH-,$$

$R_5$ denotes $(CH_2)_3SO_3\ominus$, $R_6$, $R_7$ and $R_9$ denote H, $R_8$ denotes $(CH_2)_2CH—(CH_3)_3SO_3H$, n=0; 620;

LS-XXI-131 $X_1$=O, $X_2$=Se, $R_1$ together with $R_2$ denote the remaining members of a 5-methylbenzoxazole, $R_{10}$ together with $R_{11}$ denote the remaining members of a 5-methyl-6-methoxybenzoselenazole, $R_5$ denotes $(CH_2)_3SO_3\ominus$, $R_6$ and $R_9$ denote H, $R_7$ and $R_8$ denote $C_2H_5$, n=0; 620;

LS-XXI-132 $X_1$=S, $X_2$=Se, $R_1$ together with $R_2$ and $R_{10}$ together with $R_{11}$ in each case denote —CH=CH—CH=CH—, $R_5$ denotes $(CH_2)_2SO_2(CH_2)_2SO_3\ominus$, $R_6$ and $R_9$ denote H, $R_7$ denotes $CH_3$, $R_8$ denotes $C_2H_5$, n=0; 590;

LS-XXII-133 $X_2$=$C(CH_3)_2$, $R_1$ together with $R_2$ and $R_{10}$ together with $R_{11}$ in each case denote —CH=CH—CH=CH—, $R_5$ denotes —$(CH_2)_4$—$SO_3\ominus$, $R_6R_7$ and $R_9$ denote H, $R_8$ denote $CH_3$, n=0; 580;

Sensitizers may be omitted if the intrinsic sensitivity of the silver halide is sufficient for a particular spectral region, for example the blue sensitivity of silver iodobromides.

Colour couplers for producing the cyan partial colour image are generally couplers of the phenol or α-naphthol series or of the pyrazolopyrrole series.

Colour couplers for producing the magenta partial colour image are generally couplers of the 5-pyrazolone or indazolone or pyrazoloazole series.

Colour couplers for producing the yellow partial colour image are generally couplers having an open chain ketomethylene group, in particular couplers of the α-acylacetamide series; α-benzoylacetanilide couplers and α-pivaloylacetanilide couplers are suitable examples of these.

The colour couplers may be 4-equivalent couplers or 2-equivalent couplers. The latter are derived from 4-equivalent couplers in that they carry in the coupling position a substituent which is split off in the coupling reaction.

The couplers normally contain a ballast group to prevent diffusion within the photographic material, i.e. both within a layer and from one layer to another. High molecular weight couplers may also be used instead of couplers containing a ballast group.

Lists of suitable colour couplers and literature references in which these are described may be found in Research Disclosure 17 643 (1978), Chapter VII.

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and U.S. Pat. No. 4,080,211. The high molecular weight colour couplers are generally prepared by the polymerisation of ethylenically unsaturated monomeric colour couplers. They may also be obtained by polyaddition or polycondensation.

Incorporation of the couplers or other compounds in silver halide emulsion layers may be carried out by first preparing a solution, dispersion or emulsion of the particular compound and then adding this to the casting solution for the layer in which it is required. The choice of suitable solvents or dispersing agents depends on the solubility of the compound.

Methods of introducing compounds which are substantially insoluble in water by grinding are described, for example, in DE-A-26 09 741 and DE-A-26 09 742.

Hydrophobic compounds may also be introduced into a casting solution by means of high boiling solvents, so-called oil formers. Suitable methods are described, for example, in U.S. Pat. Nos. 2,322,027, 2,801,170, 2,801,171 and EP-A-0 043 037.

Oligomeric or polymeric compounds known as so-called polymeric oil formers may be used instead of the high boiling solvents.

The compounds may also be introduced into the casting solution in the form of charged latices; see, for example, DE-A-25 41 230, DE-A-25 41 274, DE-A-28 35 856, EP-A-0 014 921, EP-A-0 069 671, EP-A-0 130 115 and U.S. Pat. No. 4,291,113.

Diffusion fast incorporation of anionic water soluble compounds (e.g. dyes) may also be carried out with the aid of cationic polymers, so-called mordant polymers.

Examples of suitable oil formers include phthalic acid alkyl esters, phosphonic acid esters, phosphoric acid esters, citric acid esters, benzoic acid esters, amides, fatty acid esters, trimeric acid esters, alcohols, phenols, aniline derivatives and hydrocarbons.

The following are examples of suitable oil formers: dibutyl phthalate, dicyclohexyl phthalate, di-2-ethylhexyl phthalate, decyl phthalate, triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexyl-benzoate, dodecyl-benzoate, 2-ethylhexyl-p-hydroxybenzoate, diethyldodecanamide, N-tetradecylpyrrolidone, isostearyl alcohol, 2,4-di-tert.-amyl-phenol, trioctyl citrate, N,N-dibutyl-2-butoxy-5-tert-octylaniline, paraffin, dodecyl benzene and diisopropyl naphthalene.

The photographic material may also contain UV-light absorbing compounds, white toners, spacers, filter dyes, formalin acceptors, white couplers, light protective agents, antioxidants, $D_{Min}$ dyes, additives for improving the stabilization of dyes, couplers and whites and for reducing the colour fog, plasticizers (latices), biocides and others.

UV-light absorbing compounds should on the one hand protect the image dyes against bleaching by daylight which is rich in Uv-light and on the other hand act as filter dyes to absorb the UV light in daylight when exposure is carried out and thus improve the colour reproduction of the film. Compounds differing in structure are normally used for the two different problems. Examples include aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic ester compounds (U.S. Pat. Nos. 3,705,805 and 3,707,375), butadiene compounds (U.S. Pat. No. 4,045,229) and benzoxazole compounds (U.S. Pat. No. 3,700,455).

Ultraviolet absorbing couplers (such as cyan couplers of the $\alpha$-naphthol series) and ultraviolet absorbing polymers may also be used. These ultraviolet absorbents may be fixed in a particular layer by mordants.

Filter dyes suitable for visible light include oxonole dyes, hemioxonole dyes, styryl dyes, merocyanine dyes, cyanine dyes and azo dyes. Among these dyes, oxonole dyes, hemioxonole dyes and merocyanine dyes are particularly suitable.

Suitable white toners are described e.g. in Research Disclosure 17 643 (December 1978), Chapter V, in U.S. Pat. Nos. 2,632,701 and 3,269,840 and in GB-A 852 075 and 1 319 763.

Certain layers of binders, especially those which are furthest removed from the support but occasionally also interlayers, especially if these-have been the layers furthest removed from the support during preparation of the photographic material, may contain photographically inert particles of an inorganic or organic nature, e.g. as matting agents or as spacers (DE-A-33 31 542, DE-A-34 24 893 and Research Disclosure 17 643 (December 1978), Chapter XVI).

The average particle diameter of the spacers is in particular in the range of from 0.02 to 10 $\mu$m. The spacers are insoluble in water and may be soluble or insoluble in alkalies. Those which are soluble in alkalies are generally removed from the photographic material by the alkaline development bath. Examples of suitable polymers include polymethyl methacrylate, copolymers of acrylic acid and methyl methacrylate and hydroxypropyl methyl cellulose hexahydrophthalate.

Additives for improving the stability of the dyes, couplers and whites and for reducing the colour fog (Research Disclosure 17 643/1978 Chapter VII), may belong to the following classes of chemical compounds: hydroquinone, 6-hydroxychromans, 5-hydroxycoumarans, spirochromans, spiroindanes, p-alkoxyphenols, sterically hindered phenols, gallic acids derivatives, methylene dioxybenzenes, aminophenols, sterically hindered amines, derivatives containing esterified or etherified phenolic hydroxyl groups, and metal complexes.

Compounds containing both a sterically hindered amine partial structure and a sterically hindered phenol partial structure in one and the same molecule (U.S. Pat. No. 4,268,593) are particularly effective in preventing impairment (deterioration or degradation) of yellow colour images as a result of the development of heat, moisture or light. Spiroindanes (JP-A-159 644/81) and chromans substituted by hydroquinone diethers or monoethers (JP-A-89 835/80) are particularly effective in preventing the impairment (deterioration or degradation) of magenta colour images, in particular impairment (deterioration or degradation) due to the action of light.

The layers of the photographic material may be hardened with the usual hardeners such as, for example, formaldehyde, glutaraldehyde and similar aldehyde compounds, diacetyl, cyclopentadione and similar ketone compounds, bis-(2-chloroethyl urea), 2-hydroxy-4,6-dichloro-1,3,5-triazine and other compounds containing reactive halogen (U.S. Pat. Nos. 3,288,775, 2,732,303, GB-A-974 723 and GB-A-1 167 207), divinyl sulfone compounds, 5-acetyl-1,3-diacrylohexahydro-1,3,5-triazine and other compounds containing a reactive olefin bond (U.S. Pat. Nos. 3,635,718, 3,232,763 and GB-A-994 869); N-hydroxymethyl phthalimide and other N-methylol compounds (U.S. Pat. Nos. 2,732,316 and 2,586,168); isocyanates (U.S. Pat. No. 3,103,437); aziridine compounds (U.S. Pat. Nos. 3,017,280 and 2,983,611); acid derivatives (U.S. Pat. Nos. 2,725,294 and 2,725,295); compounds of the carbodiimide series (U.S. Pat. No. 3,100,704); carbamoylpyridinium salts (DE-A-22 25 25 230) and DE-A-24 39 551); carbonmyloxypyridinium compounds (DE-A-24 08 814); compounds containing a phosphorus-halogen bond (JP-A-113 929/83); N-carbonyloximide compounds (JP-A-43353/81); N-sulfonyloximido compounds (U.S. Pat. No. 4,111,926), dihydroquinoline compounds (U.S. Pat. No. 4,013,468), 2-sulfonyloxypyridinium salts (JP-A-110 762/81), formamidinium salts (EP-A 0 162 308), compounds having two or more N-acyloximino groups (U.S. Pat. No. 4,052,373), epoxy compounds (U.S. Pat. No. 3,091,537), compounds of the isoxazole series (U.S. Pat. Nos. 3,321,313 and 3,543,292); halogen carboxyaldehydes such as mucochloric acids, dioxane derivatives such as dihydroxydioxane and dichlorodioxane; and inorganic hardeners such as chrome alum and zirconium sulfate.

Hardening may be carried out in a known manner by adding the hardener to the casting solution for the layer to be hardened or by coating the layer to be hardened with a layer containing a diffusible hardener.

The classes mentioned above include slow acting hardeners and quick acting hardeners as well as so-called instant hardeners, which are particularly advantageous. Instant hardeners are compounds which cross-link suitable binders at such a rate that hardening has been sufficiently completed immediately after casting or after 24 hours at the latest, preferably after not more than 8 hours, to ensure that no further change in sensitometry and swelling of the combination of layers occurs as a result of the cross-linking reaction. Swelling is understood to be the difference between the wet layer thickness and the dry layer thickness of a film which is processed under aqueous conditions (Photogr. Sci. Eng. 8 (1964), 275; Photographic Sci. Eng. (1972), 449).

These hardeners which react very rapidly with gelatine may be, for example, carbomoylpyridinium salts, which are capable of reacting with free carboxyl groups of gelatine so that these react with free amino groups of gelatine to form peptide bonds with cross-linking of the gelatine.

Some hardeners are diffusible and have an equal hardening action on all the layers within a combination of layers while others are non-diffusible, low molecular weight or high molecular weight hardeners whose action is limited to the layer in which they are contained. These are capable of particularly strong cross-linking of individual layers, e.g. the protective layer. This is important when the silver halide layer undergoes little hardening due to an increase in the silver covering power so that the protective layer must be used for improving the mechanical properties (EP-A-0 114 699).

The colour photographic materials according to the invention are normally processed by development, bleaching, fixing and washing or stabilization without washing, and the processes of bleaching and fixing may be combined in a single operating step. The colour developer compound used may be any developer compound which is capable, in the form of its oxidation product, of reacting with colour couplers to form azomethine or indophenol dyes. Suitable colour developer compounds include aromatic compounds of the p-phenylene diamine series containing at least one primary amino group; for example, N,N-dialkyl-p-phenytenediamines such as N-N-diethyl-p-phenylenediamine, 1-(N-ethyl-N-methanesulfonamidoethyl)-3-methyl-p-phenylediamine, 1-(N-ethyl-N-hydroxyethyl)-3-methyl-p-phenylenediamine and 1-(N-ethyl-N-methoxyethyl)-3-methyl-p-phenylenediamine. Other suitable colour developers are described, for example, in J. Amer. Chem. Soc. 73, 3106 (1951) and by G. Haist in Modern Photographic Processing, 1979, John Wiley and Sons, New York, page 545 et seq.).

Colour development may be followed by an acid short stop bath or by washing.

The material is conventionally bleached and fixed after colour 3development. Suitable bleaching agents are e.g. Fe(III)-salts and Fe(III)-complex salts such as ferricyanides, dichromates and water soluble cobalt complexes. Iron-(III) complexes of aminopolycarboxylic acids are particularly preferred, in particular e.g. the iron (iii) complexes of ethylene diaminotetracetic acid, propylene diaminotetracedic acid, diethylene triaminopentacetic acid, nitrilotriacetic acid, alanine diacetic acid, iminodiacetic acid, N-hydroxyethylethylenediaminiotriacetic acid, alkyl iminodicarboxylic acids and of corresponding phosphonic acids. Persulphates and peroxides are also suitable bleaching agents, e.g. hydrogen peroxide.

The bleach fixing bath or fixing bath is in most cases followed by washing, which is carried out as a counter-flow washing in several tanks, each with its own water supply.

Advantageous results can be obtained when this process is followed by a final bath containing little or no formaldehyde.

Washing may be completely replaced by a stabilizing bath, which is usually carried out in counter-current. This stabilizing bath also functions as a final bath when formaldehyde is added.

The colour photographic material according to the invention may also be subjected to a reverse development, in which case colour development is preceded by a first development with a developer which does not form a dye with the couplers and a diffuse second exposure or chemical fogging.

The material according to the invention is, however, preferably a colour negative material, in particular colour negative paper or display material.

EXAMPLES

A colour photographic recording material suitable for rapid processing was prepared by applying the following layers in the sequence given to a paper which was coated with polyethylene on both sides. The quantities given are based in each case on 1 $m^2$. The quantities of silver halide applied are given in terms of the corresponding quantities of $AgNO_3$.

Example 1

Layer Arrangement 1

First layer (Subbing layer)
0.2 g gelatine
Second layer (Blue sensitive layer)
Blue sensitive silver halide emulsion (99.5 mol % chloride, 0.5 mol % bromide, average grain diameter 0.78 μm) of 0.50 g $AgNO_3$, sensitization maximum 480 nm, with
1.38 g gelatine
0.60 g yellow coupler Y-1
0.48 g tricresyl phosphate (TCP)
Third layer (Interlayer)
1.18 g gelatine
0.08 g 2.5-dioctylhydroquinone
0.08 g dibutyl phthalate (DBP)
Fourth Layer (Green sensitive layer)
Green sensitized silver halide emulsion (99.5 mol % chloride, 0.5 mol % bromide, average grain diameter 0.37 μm) of 0.40 g $AgNO_3$, sensitization maximum 550 nm, with
1.02 g gelatine
0.37 g magenta coupler M-1
0.40 g DBP
Fifth Layer (Interlayer)
1.20 g gelatine
0.66 g UV-absorbent corresponding to the following formula

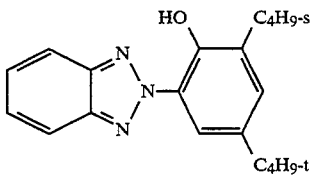

0.052 g 2,5-dioctylhydroquinone
0.36 g TCP
Sixth Layer (Red sensitive layer)
Red sensitized silver halide emulsion (99.5 mol % chloride, 0.5 mol % bromide, average grain diameter
0.35 μm) of 0.28 g $AgNO_3$, sensitization maximum 708 nm, with
0.84 g gelatine
0.39 g cyan couplers C-1
0.39 g TCP
Seventh Layer (UV-Protective layer)
0.65 g gelatine
0.21 g of the UV-absorbent used in layer 5
0.11 g TCP
Eighth Layer (Protective layer)
0.65 g gelatine
0.39 g hardener corresponding to the following formula

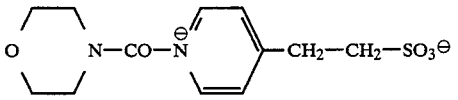

Example 2 (Comparison)

A colour photographic recording material was prepared which differed from that of Example 1 in that the red sensitive emulsion in layer 6 was in addition green sensitized with GS 1 (50 μmol/mol Ag).

Example 3 (Comparison)

A colour photographic recording material was prepared which differed from that described in Example 1 in that layer 6 was in addition blue sensitized with 100 μmol/mol Ag BS-1.

Example 4 (Invention)

A colour photographic recording material was prepared which differed from that of Example 1 in that the red sensitive layer containing a cyan coupler contained an additional silver halide emulsion (99.5 mol % chloride, 0.5 mol % bromide, average grain diameter 0.4 μm) of 0.1 g $AgNO_3$ which was gap sensitized with LS-IV-53 (20 μmol/mol Ag).

Example 5 (Invention)

A colour photographic recording material was prepared which differed from that of Example 1 in that the red sensitive emulsion was-in addition gap sensitized with LS-I-I (100 μmol/mol Ag).

Example 6 (Invention)

A colour photographic recording material was prepared which differed from that of Example 1 in that the blue sensitive emulsion was in addition gap sensitized with LS-XXI-106 (100 μml/mol Ag).

The materials were subjected to the following exposures a), b), c) or d) and processed as described.

Exposure a) Through a step wedge with filter permeable to green light.
b) Through a step wedge with filter permeable to blue light.
c) Through a step wedge with a filter permeable to blue and green light and an additional magenta and yellow filter so that a clear red was obtained on the processed material over the whole density range.
d) Through a step wedge with a filter permeable to red and green light and a magenta filter to produce a clear blue.

The results were then examined by
a) determining the number of recognizable steps and
b) determining the percentage proportion of cyan (BG) (=side density, ND) at density 2.0 in magenta (PP) or yellow (GB); $ND_{BG}=[D_{BG}$ at $D_{pp}=2.0)/D_{pp}=2.0]$. 100.

| | | Results | | |
|---|---|---|---|---|
| Material | Exposure | Number of steps | (%) $ND_{BG}$ | |
| 1 | a | 15 | 10.0 | Comparison |
| 1 | b | 15 | 3.0 | Comparison |
| 1 | c | 16 | — | Comparison |
| 1 | d | 16 | — | Comparison |
| 2 | a | 17 | 13.5 | Comparison |
| 2 | c | 17 | — | Comparison |
| 3 | b | 16 | 8.0 | Comparison |
| 3 | c | 17 | — | Comparison |
| 4 | a | 17 | 10.2 | Invention |
| 4 | b | 16 | 3.0 | Invention |
| 4 | c | 21 | — | Invention |
| 5 | a | 17 | 10.0 | Invention |
| 5 | b | 15 | 3.2 | Invention |
| 5 | c | 21 | — | Invention |
| 6 | a | 17 | 10.3 | Invention |
| 6 | d | 20 | — | Invention |

The examples confirm that the invention provides a larger number of developable steps and a better rendering of detail in the important red reproduction (Exposure c)) without the usual concomitant desaturation of the colour magenta (Exposure a)) or yellow (Exposure b)) as in Comparison material 2 or 3.

Comparison samples and material according to the invention were exposed with a colour negative (picture theme) and treated by the process described. The material according to the invention shows significantly better detail reproduction in the region of high red densities than the comparison samples of Examples 1, 2 and 3, less colour falsification at high magenta densities than the comparison sample of Example 2 and less colour falsification at high yellow densities than the comparison sample of Example 3.

Y-1

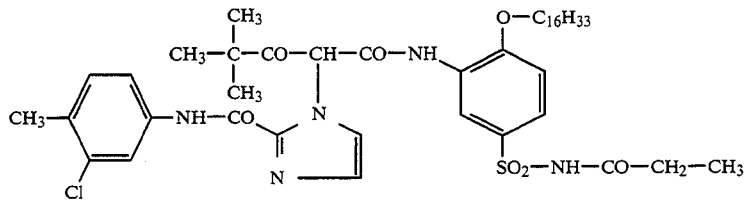

M-1

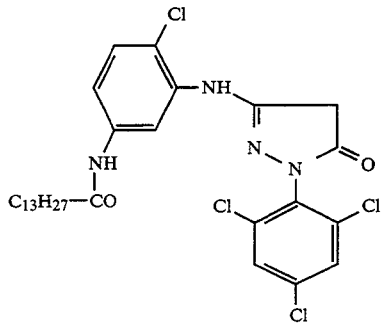

C-1

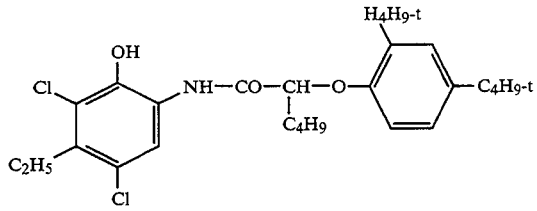

RS-1

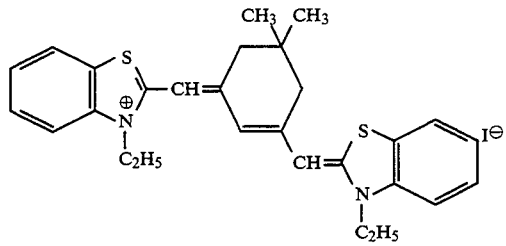

Sensitization maximum: 708 nm

BS-1

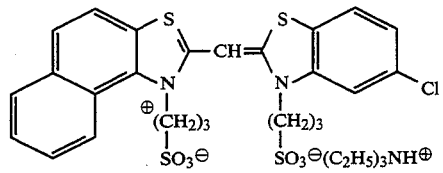

Sensitization maximum: 480 nm

-continued

GS-1

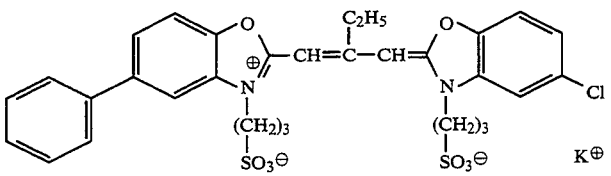

Sensitization maximum: 550 nm a) Colour Developer—45 s—35° C.

| | |
|---|---|
| Triethanolamine | 9.0 g/l |
| N,N-diethylhydroxylamine | 4.0 g/l |
| Diethylene glycol | 0.05 g/l |
| 3-Methyl-4-amino-N-ethyl-N-methane-sulfonamidoethyl-aniline-sulfate | 5.0 g/l |
| Potassium sulfate | 0.2 g/l |
| Triethylene glycol | 0.05 g/l |
| Potassium carbonate | 22 g/l |
| Potassium hydroxide | 0.4 g/l |
| Ethylene diaminotetracetic acid, disodium salt | 2.2 g/l |
| Potassium chloride | 2.5 g/l |
| 1,2-Dihydroxybenzene-3,4,6-trisulfonic acid, trisodium salt | 0.3 g/l |
| made up with water to 1,000 ml; pH 10.2 | 0.3 g/l |

b) Bleach fixing bath—45 s—35° C.

| | |
|---|---|
| Ammonium thiosulphate | 75 g/l |
| Sodium hydrogen sulphite | 13.5 g/l |
| Ammonium acetate | 2.0 g/l |
| Ethylene diaminotetracetic acid (Iron-ammonium salt) | 57 g/l |
| Ammonia, 25% by weight | 9.5 g/l |
| Acetic acid | 9.0 g/l |
| made up with water to 1,000 ml; pH 5.5 | |

c) Washing—2 min—33° C.

d) Drying

We claim:

1. Color photographic silver halide material comprising on a support, at least one red sensitive layer containing a cyan coupler and a red sensitizer, at least one green sensitive layer containing a magenta coupler and a green sensitizer and at least one blue sensitive layer containing a yellow coupler and a blue sensitizer, wherein at least one blue sensitive silver halide emulsion layer contains an additional spectral sensitizer (gap sensitizer) whose sensitization maximum lies between the sensitization maxima of the red sensitive and the green sensitive silver halide emulsion layer and/or the at least one red sensitive silver halide emulsion layer contains an additional spectral sensitization (gap sensitizer) whose sensitization maximum lies between the sensitization maxima of the green sensitive and the blue sensitive silver halide emulsion layer.

2. Color photographic silver halide material according to claim 1, wherein the sensitization maximum of the gap sensitizer is separated by at least 15 nm from the absorption maxima of the green and blue sensitizers and the sensitization maximum of the gap sensitizer is separated by at least 30 nm from the absorption maximum of the red sensitizer.

3. Color photographic silver halide material according to claim 1, wherein the gap sensitizer corresponds to one of the formulae I to XI, XXVI and XXVII (I)

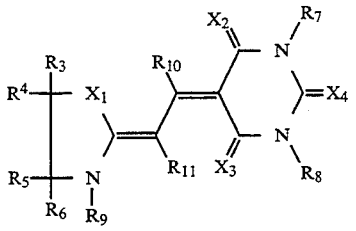

(II)

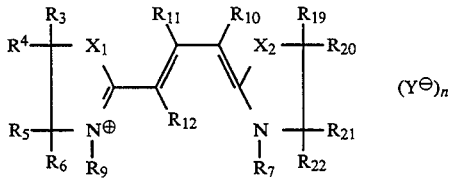

(III)

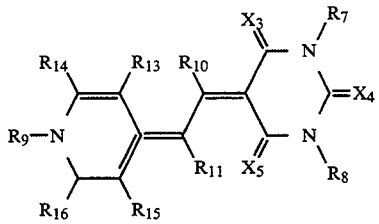

-continued
(IV)
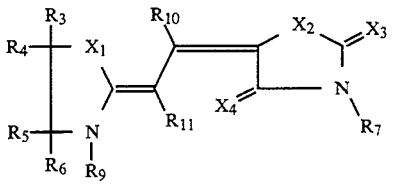
(V)
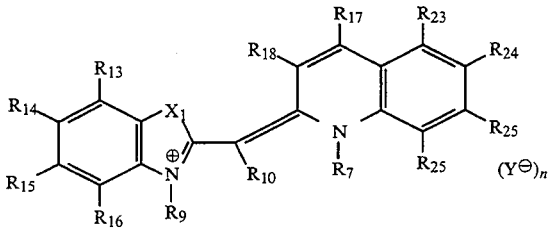
(VI)
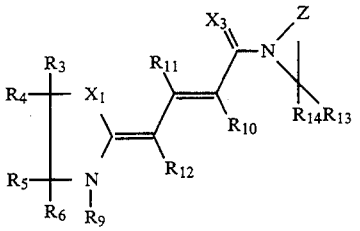
(VII)
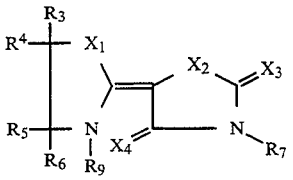
(VIII)
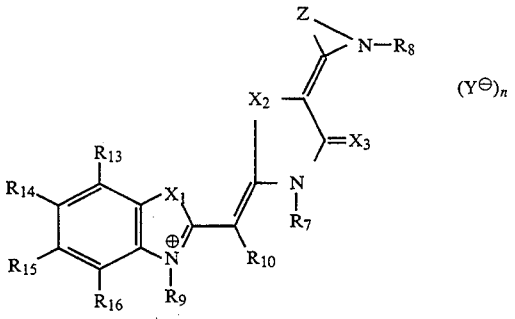
(IX)
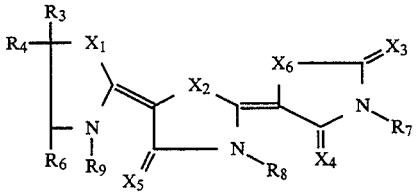
(XI)
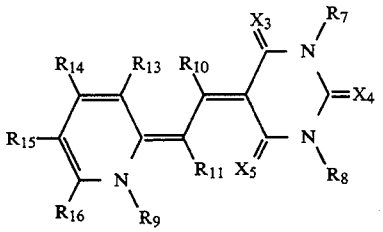

-continued (XXVI)

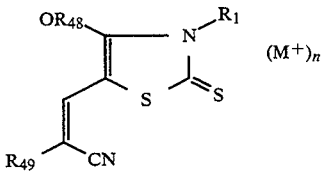

(XXVII)

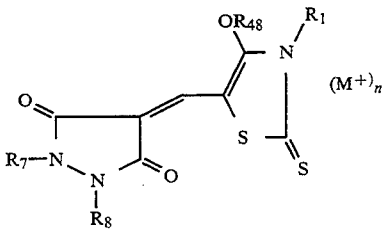

wherein $X_1$–$X_6$ are the same or different and denote O, $NR_1$, S, Se, Te, $P(R_1)$, $P(R_1)_3$, $CH_2$, $CHR_2$, or $C(R_22)_2$ $R_1$ denotes alkyl, sulphoalkyl, carboxyalkyl or aryl, $R_2$ denotes aryl, alkyl, or CN $R_3$, $R_4$, $R_5$, $R_6$, $R_{19}$, $R_{20}$, $R_{21}$ and $R_{22}$ are the same or different and denote hydrogen, halogen, alkoxy, aryloxy, cyano, hydroxy, sulfo, carboxy, alkoxycarbonyl, aryloxycarbonyl, acylaminosulfonyl, aminosulfonyl, alkylaminosulfonyl, dialkylaminosulfonyl, arylaminosulfonyl, diarylaminosulfonyl, aryl, arylmercapto, alkylmercapto or alkyl or $R_3$ and $R_6$ together or $R_{19}$ and $R_{22}$ together form a $\pi$ bond $R_4$ and $R_5$ together or $R_{20}$ and $R_{21}$ together form a 3 to 12 membered ring which may contain heteroatoms and multiple bonds, $R_7$, $R_8$ and $R_9$ are the same or different and denote alkyl, substituted or unsubstituted sulfoalkyl, carboxyalkyl or aryl, $R_{10}$, $R_{11}$ and $R_{12}$ are the same or different and denote hydrogen, halogen, cyano, aryl, aryloxy, arylmercapto, alkyl, alkoxy or alkylmercapto, $R_{13}$, $R_{14}$, $R_{15}$, $R_{16}$, $R_{17}$, $R_{18}$, $R_{23}$, $R_{24}$, $R_{25}$ and $R_{26}$ are the same or different and denote hydrogen, halogen, alkoxy, cyano, hydroxy, sulfo, carboxy, alkoxycarbonyl, aryloxycarbonyl, acyloxycarbonyl, acylaminosulfonyl, aminosulfonyl, alkylaminosulfonyl, arylaminosulfonyl, diarylaminosulfonyl, aryl, aryloxy, arylmercapto, alkyl or alkylmercapto, $R_{48}$ denotes hydrogen, alkyl, sulfoalkyl, carboxylalkyl, acyl or a negative charge, $R_{49}$ denotes —CN, $—CON(R_1)_2$ or $—SO_2R_1$, Z denotes the remaining members of a 3 to 12 membered ring which may contain heteroatoms and double bonds, $M^{\oplus}$ denotes a cation, $Y^{\ominus}$ denotes an anion and n stands for 0 or 1.

4. Color photographic silver halide material according to claim 1, wherein the gap sensitizer corresponds to one of the Formulae XII to XIX (XII)

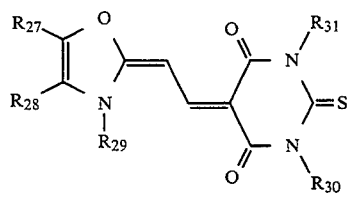

(XIII)

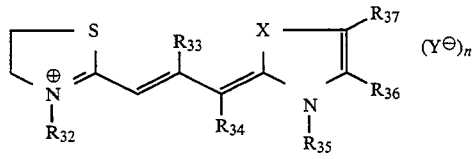

(XIV)

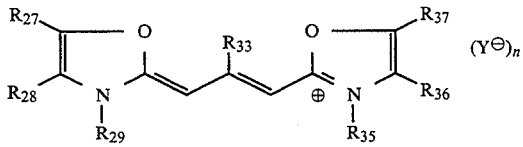

(XV)

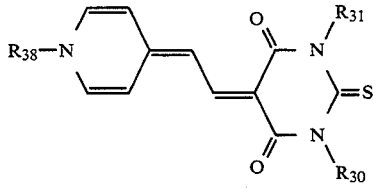

(XVI)

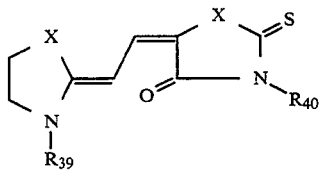

(XVII)

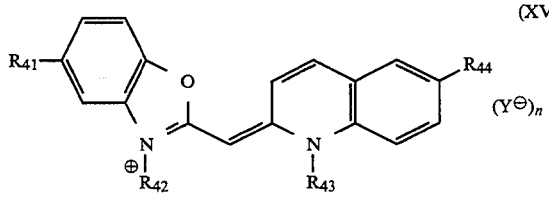

-continued (XVIII)

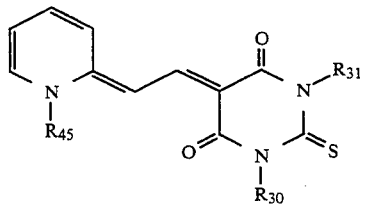

(XIX)

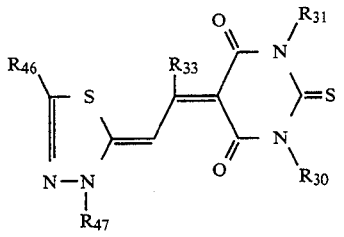

wherein

X denotes O, S, Se or $NR_1$, $R_1$ denotes alkyl, sulphoalkyl, carboxyalkyl or aryl, $R_{27}$ and $R_{28}$ are the same or different and denote H, $CH_3$, phenyl, 2-furyl, Cl, methoxycarbonyl or ethoxycarbonyl, $R_{29}$, $R_{32}$, $R_{35}$, $R_{38}$, $R_{39}$, $R_{40}$, $R_{42}$, $R_{43}$, $R_{45}$, and $R_{47}$ are the same or different and denote methyl, ethyl sulfoalkyl or carboxyalkyl, $R_{30}$ and $R_{31}$ are the same or different and denote hydrogen or $R_{29}$, $R_{33}$ denotes hydrogen, methyl or ethyl, $R_{34}$ denotes H or CN, $R_{36}$ and $R_{37}$ are the same or different and denote H, $CH_3$, $C_2H_5$, phenyl, ethoxy, morpholinocarbonyl, 1-hydroxyisopropyl, Cl, methoxycarbonyl or ethoxycarbonyl, $R_{41}$ denotes H, Cl, $CH_3$, OH, $OCH_3$ or phenyl, $R_{44}$ denotes H or $OCH_3$ $R_{45}$ denotes H, $CH_3$, $SCH_3$, Cl, or phenyl.

5. Color photographic silver halide material according to claim 1, wherein the gap sensitizer corresponds to one of the Formulae XX to XXII (XX)

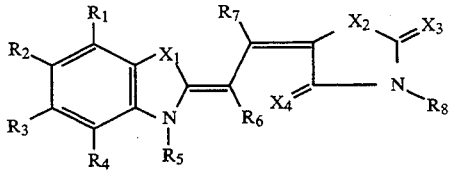

(XXI)

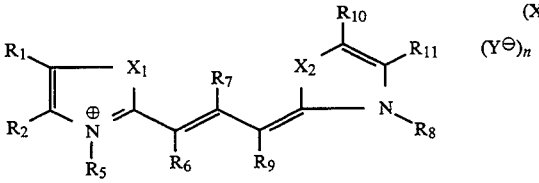

(XXII)

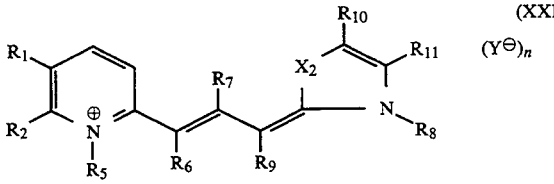

wherein $R_1$, $R_2$, $R_3$, $R_4$, $R_{10}$ and $R_{11}$ are the same or different and denote hydrogen, halogen, alkoxy, aryloxy, cyano, hydroxy, sulfo, carboxy, alkoxycarbonyl, aryloxycarbonyl, acylaminosulfonyl, aminosulfonyl, alkylaminosulfonyl, dialkylaminosulfonyl, arylaminosulfonyl, diarylaminosulfonyl, aryl, arylmercapto, allcylmercapto or alkyl or $R_1$ and $R_2$ together or $R_2$ and $R_3$ together or $R_3$ and $R_4$ together or $R_{10}$ and $R_{11}$ together form an aromatic or heteroaromatic 3 to 12 membered ring, $R_5$ and $R_8$ are the same or different and denote aryl, alkyl, sulfoalkyl unsubstituted or substituted by OH or carboxyalkyl $R_6$, $R_7$ and $R_9$ are the same or different and denote hydrogen, halogen, cyano, aryl, arylmercapto, aryloxy, alkyl, alkylmercapto or alkoxy $X_1$, $X_2$, $X_3$ and $X_4$ are the same or different and denote O, NR, S, Se, Te, PR, $PR_3$, $CH_2$, CH-alkyl, $C(Alkyl)_2$, CH-aryl or $C(Aryl)_2$, $Y^{\ominus}$ denotes an anion and n stands for 0 or 1.

6. Color photographic silver halide material according to claim 5, wherein the gap sensitizer corresponds to one of the formulae XXIII to XXV (XXIII)

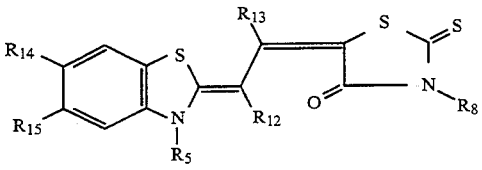

(XXIV)

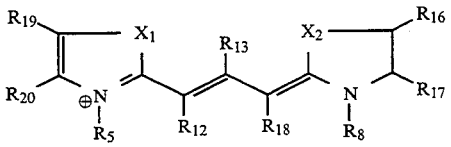

(XXV)

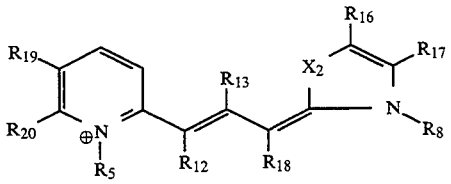

$R_{12}$, $R_{13}$ and $R_{18}$ are the same or different and denote H or $CH_3$, $R_{14}$ and $R_{15}$ are the same or different and denote H, $CH_3$, Cl or phenyl, $R_{16}$, $R_{17}$, $R_{19}$ and $R_{20}$ are the same or different and denote H, $CH_3$, Cl or phenyl or together with $R_{17}$ or $R_{19}$ stand for the remaining members of an aromatic or heteroaromatic ring.

7. Color photographic material of claim 1, wherein the gap sensitizer is according to formulae I to XI, XXVI, XXVII, XII to XIX, XX to XXII and XXIII to XXV of (I)
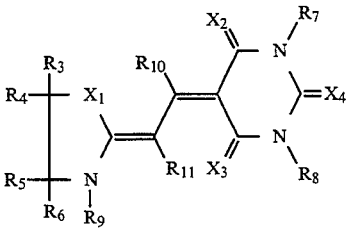
(II)
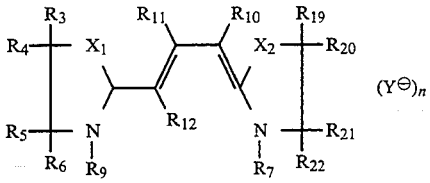
(III)
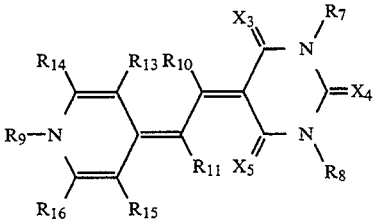
(IV)
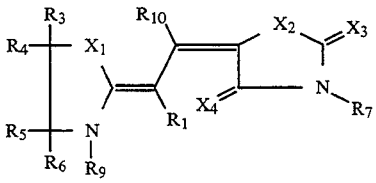
(V)
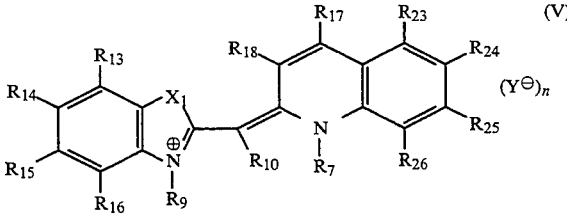
(VI)
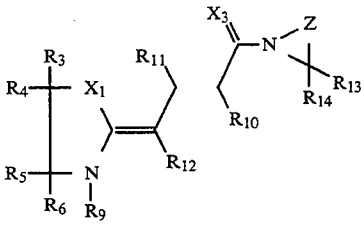
(VII)
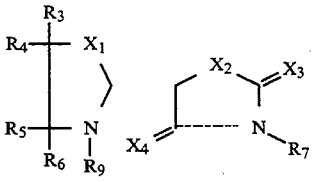
-continued
(VIII)
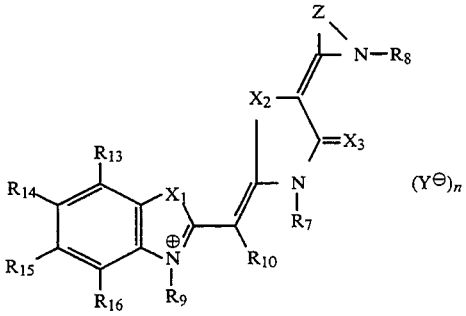
(IX)
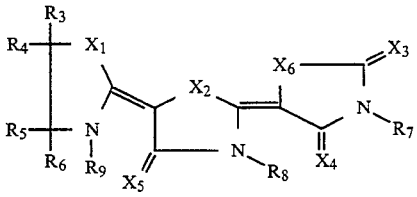
(X)
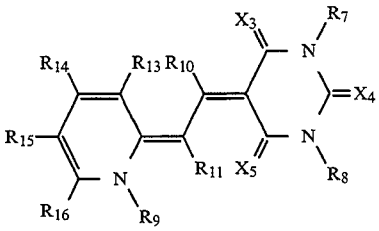
(XI)
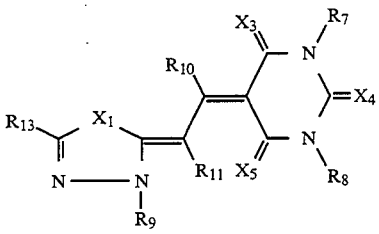
(XXVI)
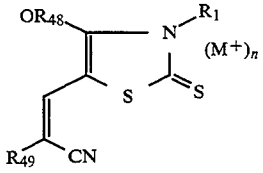
(XXVII)
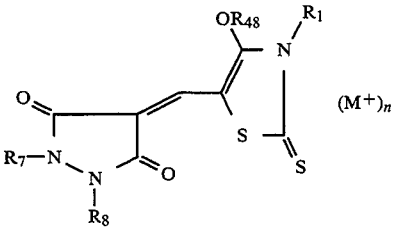
(XII)
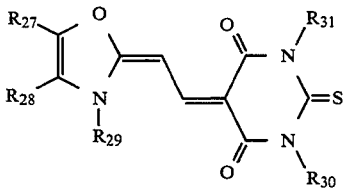

-continued (XIII)

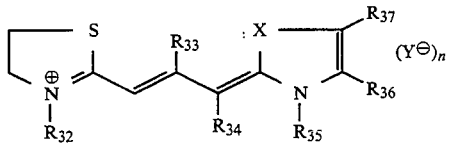

(XIV)

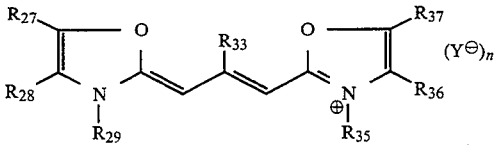

(XV)

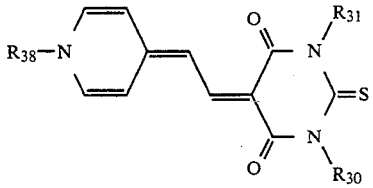

(XVI)

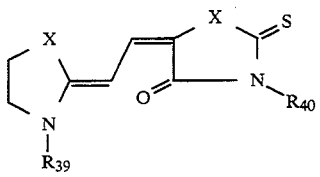

(XVII)

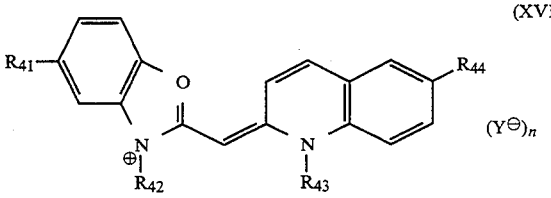

(XVIII)

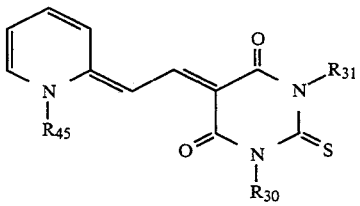

(XIX)

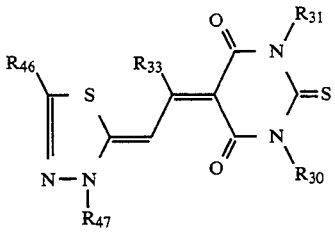

(XX)

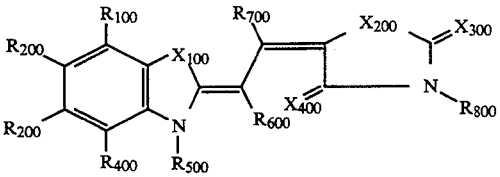

-continued (XXI)

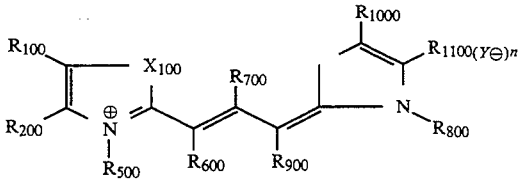

(XXII)

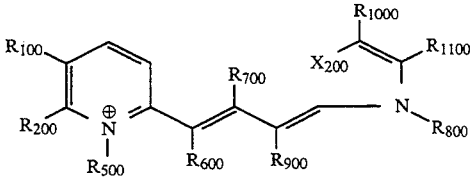

(XXIII)

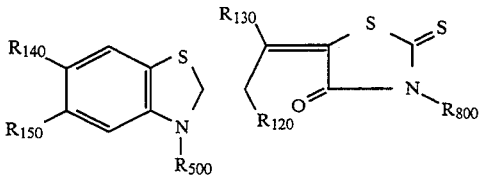

(XXIV)

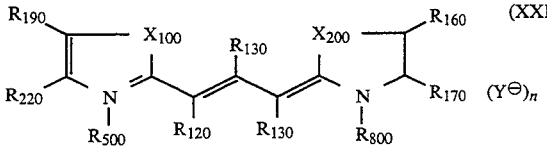

(XXV)

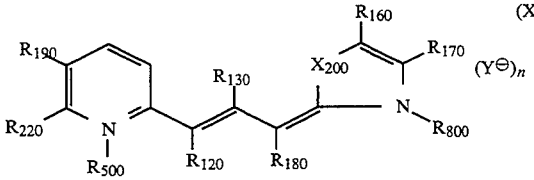

wherein $X_1$–$X_6$ are the same or different and denote O, $NR_1$, S, Se, Te, $P(R_1)$, $P(R_1)_3$, $CH_2$, $CHR_2$, or $C(R_2)_2$ $R_1$ denotes alkyl, sulphoalkyl, carboxyalkyl or aryl, $R_2$ denotes aryl, alkyl, or CN $R_3$, $R_4$, $R_5$, $R_6$, $R_{19}$, $R_{20}$, $R_{21}$ and $R_{22}$ are the same or different and denote hydrogen, halogen, alkoxy, aryloxy, cyano, hydroxy, sulfo, carboxy, alkoxycarbonyl, aryloxycarbonyl, acylaminosulfonyl, aminosulfonyl, alkylaminosulfonyl, dialkylaminosulfonyl, arylaminosulfonyl, diarylaminosulfonyl, aryl, arylmercapto, alkylmercapto or alkyl or $R_3$ $R_6$ together or $R_{19}$ and $R_{22}$ together form a $\pi$ bond $R_4$ and $R_5$ together or $R_{20}$ and $R_{21}$ together form a 3 to 12 membered ring which may contain heteroatoms and multiple bonds, $R_7$, $R_8$ and $R_9$ are the same or different and denote alkyl, sulfoalkyl, carboxyalkyl or aryl, $R_{10}$, $R_{11}$ and $R_{12}$ are the same or different and denote hydrogen, halogen, cyano, aryl, aryloxy, arylmercapto, alkyl, alkoxy or alkylmercapto, $R_{13}$, $R_{14}$, $R_{15}$, $R_{16}$, $R_{17}$, $R_{18}$, $R_{23}$, $R_{24}$, $R_{25}$ and $R_{26}$ are the same or different and denote hydrogen, halogen, alkoxy, cyano, hydroxy, sulfo, carboxy, alkoxycarbonyl, aryloxycarbonyl, acyloxycarbonyl, acylaminosulfonyl, aminosulfonyl, alkylaminosulfonyl, arylaminosulfonyl, diarylaminosulfonyl, aryl, aryloxy, arylmercapto, alkyl or alkylmercapto, $R_{48}$ denotes hydrogen, alkyl, sulfoalkyl, carboxylalkyl, acyl or a negative charge, $R_{49}$ denotes —CN, —$CON(R_1)_2$ or —$SO_2R_1$, Z denotes the remaining members of a 3 to 12 membered ring which may contain heteroatoms and double bonds, $M^{\oplus}$ denotes a cation, $Y^{\ominus}$ denotes an anion and n stands for 0 or 1, X denotes O, S, Se or $NR_1$, $R_{27}$ and $R_{28}$ are the same or different and denote H, $CH_3$, phenyl, 2-furyl, Cl, methoxycarbonyl or ethoxycarbonyl, $R_{29}$, $R_{32}$, $R_{35}$, $R_{38}$, $R_{39}$, $R_{40}$, $R_{42}$, $R_{43}R_{45}$, and $R_{47}$ are the same or different and denote methyl, ethyl sulfoalkyl or carboxyalkyl, $R_{30}$ $R_{31}$ are the same or different and denote hydrogen or $R_{29}$, $R_{33}$ denotes hydrogen, methyl or ethyl, $R_{34}$ denotes H or CN, $R_{36}$ and $R_{37}$ are the same or different and denote H, $CH_3$, $C_2H_5$, phenyl, ethoxy, morpholinocarbinoyl, 1-hydroxyisopropyl, Cl, methoxycarbonyl or ethoxycarbonyl, $R_{41}$ denotes H, Cl, $CH_3$, OH, $OCH_3$ or phenyl, $R_{44}$ denotes H or $OCH_3$ $R_{45}$ denotes H, $CH_3$, $SCH_3$, Cl or phenyl $R_{100}$, $R_{200}$, $R_{300}$, $R_{400}$, $R_{1000}$ and $R_{1100}$ are the same or different and denote hydrogen, halogen, alkoxy, aryloxy, cyano, hydroxy, sulfo, carboxy, alkoxycarbonyl, aryloxycarbonyl, acylaminosulfonyl, aminosulfonyl, alkylaminosulfonyl, dialkylaminosulfonyl, arylaminosulfonyl, diarylaminosulfonyl, aryl, arylmercapto, alkylmercapto or alkyl or $R_{100}$ and $R_{200}$ together or $R_{200}$ and $R_{300}$ together or $R_{300}$ and $R_{400}$ together or $R_{1000}$ and $R_{1100}$ together form an aromatic or heteroaromatic 3 to 12 membered ring, $R_{500}$ $R_{800}$ are the same or different and denote aryl, alkyl, sulfoalkyl unsubstituted or substituted by OH or carboxyalkyl $R_{600}$, $R_{700}$ and $R_{900}$ are the same or different and denote hydrogen, halogen, cyano, aryl, arylmercapto, aryloxy, alkyl, alkylmercapto or alkoxy $X_{100}$, $X_{200}$, $X_{300}$ and $X_{400}$ are the same or different and denote O, NR, S, Se, Te, PR, $PR_3$, $CH_2$, CH-alkyl, $C(Alkyl)_2$, CH-aryl or $C(Aryl)_2$, $R_{120}$, $R_{130}$ $R_{180}$ are the same or different and denote H or $CH_3$, $R_{140}$ and $R_{150}$ are the same or different and denote H, $CH_3$, Cl or phenyl, $R_{160}$, $R_{170}$, $R_{190}$ and $R_{220}$ are the same or different and denote H, $CH_3$, Cl or phenyl or together with $R_{170}$ or $R_{190}$ stand for the remaining members of an aromatic or heteroaromatic ring and, is added to the silver halide emulsion after the step of physical ripening.

8. The color photographic silver halide material as claimed in claim 3, wherein $R_1$ denotes phenyl and $R_2$ denotes phenyl or alkyl with 1 to 5 carbon atoms.

9. The color photographic silver halide material as claimed in claim 5, wherein $R_1$ and $R_2$ together or $R_2$ and $R_3$ together or $R_3$ and $R_4$ together or $R_{10}$ and $R_{11}$ together, form a condensed benzo or naphtho ring.

10. The color photographic silver halide material as claimed in claim 1, wherein the gap sensitizer in the blue sensitive layer or in the red sensitive layer is used in a quantity of from 0.01 to 3 $\mu mol/m^2$.

11. The color photographic material according to claim 1, wherein the gap sensitizer is added to the silver halide emulsion after the step of chemical ripening of the silver halide grains comprising the said silver halide emulsion.

12. The color photographic silver halide material as claimed in claim 1, wherein all the layers that are light sensitive contain silver halide emulsions in said layers and said silver halide emulsions contain at least 80% chloride.

13. The color photographic silver halide material as claimed in claim 12, wherein all the light sensitive layers contain silver halide emulsions in said layers and said silver halide emulsions contain 95 to 100 mol % of chloride, 0 to 5 mol % of bromide and 0 to 1 mol % of iodide.

14. The color photographic silver halide material as claimed in claim 11, wherein gold compounds or compounds of divalent sulfur are used in the chemical ripening step.

15. The color photographic silver halide material as claimed in claim 1, wherein the silver halide is precipitated out in the presence of a binder at an acid neutral or alkaline pH and wherein said binder is gelatin or it may be partially or completely replaced by other synthetic, semi-synthetic or naturally occurring polymers.

16. The color photographic silver halide material as claimed in claim 15, wherein said binder is selected from the group consisting of polyvinyl alcohol, poly-N-vinyl pyrrolidone, polyacrylamide, polyarcylic acid, albumin, casein, cellulose, chitine, chitosane, sugar, starch and alginate.

17. The color photographic silver halide material as claimed in claim 1, further comprising additional compounds for preventing fogging or for stabilizing the photographic function during the production, storage or photographic processing.

18. The color photographic silver halide material as claimed in claim 1, wherein the red sensitizer is selected from the group consisting of dicarbocyanines containing naphthothiazole end groups, dicarbocyanines containing benzothiozole end groups, which both may be substituted in the 5 and/or 6 position by halogen, methyl or methoxy and 9,11-neopentylene-thiadicarbocyanines carrying alkyl or sulphoalkyl substitutents on the nitrogen; the green sensitizers are 9-ethyloxacarbocyanines which are substituted in the 5 position by chlorine or phenyl and carry an alkyl or sulphoalkyl groups on the nitrogen of the benzoxazole group; and the blue sensitizers are methine cyanines carrying benzoxazole, benzothiazole, benzoselenazole, naphthoxazole or naphthothiazole as the end groups which may be substituted in the 5 and/or 6 position by halogen, methyl, methoxy and have at least one sulphoalkyl substitutent on the nitrogen.

* * * * *